US010427416B2

(12) United States Patent
Suzuki

(10) Patent No.: US 10,427,416 B2
(45) Date of Patent: Oct. 1, 2019

(54) RECORDING APPARATUS AND METHOD FOR CONTROLLING THE SAME

(71) Applicant: BROTHER KOGYO KABUSHIKI KAISHA, Nagoya-shi, Aichi-ken (JP)

(72) Inventor: Shuhei Suzuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/933,944

(22) Filed: Mar. 23, 2018

(65) Prior Publication Data

US 2018/0281450 A1 Oct. 4, 2018

(30) Foreign Application Priority Data

Mar. 31, 2017 (JP) ..... 2017-072068

(51) Int. Cl.

| | |
|---|---|
| ***B41J 2/21*** | (2006.01) |
| ***B41J 2/045*** | (2006.01) |
| ***B41J 2/205*** | (2006.01) |
| ***B41J 2/155*** | (2006.01) |

(52) U.S. Cl.

CPC ..... *B41J 2/2146* (2013.01); *B41J 2/04568* (2013.01); *B41J 2/04586* (2013.01); *B41J 2/155* (2013.01); *B41J 2/2054* (2013.01); *B41J 2/2132* (2013.01); *B41J 2202/21* (2013.01)

(58) Field of Classification Search

CPC ..... B41J 2/04568

See application file for complete search history.

(56) References Cited

U.S. PATENT DOCUMENTS

| | | | | |
|---|---|---|---|---|
| 2005/0035987 | A1* | 2/2005 | Kakutani | B41J 2/2132 347/15 |
| 2014/0285546 | A1 | 9/2014 | Furuta | |
| 2015/0022574 | A1* | 1/2015 | Shirakawa | B41J 29/38 347/9 |
| 2015/0239240 | A1* | 8/2015 | Hamada | B41J 2/04563 347/10 |
| 2015/0266291 | A1 | 9/2015 | Hasegawa | |
| 2016/0236466 | A1* | 8/2016 | Takahashi | B41J 2/04515 |

FOREIGN PATENT DOCUMENTS

| | | | |
|---|---|---|---|
| JP | 2014-180801 | A | 9/2014 |
| JP | 2015-178201 | A | 10/2015 |
| JP | 2015-178203 | A | 10/2015 |
| JP | 2016-13645 | A | 1/2016 |

* cited by examiner

*Primary Examiner* — Shelby L Fidler

(74) *Attorney, Agent, or Firm* — Merchant & Gould P.C.

(57) ABSTRACT

A recording apparatus includes a head and a controller. The controller discriminates first and second regions on a recording medium based on received image data, sets a boundary region that includes a boundary of the first and second regions, sets a first discharge speed for a discharge speed of droplets from the head to be landed to a first main region included in the first region, sets a second discharge speed slower than the first discharge speed for a discharge speed of droplets from the head to be landed to a second main region included in the second region, and sets a discharge speed between the first discharge speed and the second discharge speed for a discharge speed of droplets form the head to be landed to the boundary region.

20 Claims, 19 Drawing Sheets

| | |
|---|---|
| NOZZLE GROUP 51a | V2a |
| NOZZLE GROUP 51b | V2b |
| NOZZLE GROUP 51c | V2c |
| NOZZLE GROUP 51d | V2d |
| NOZZLE GROUP 51e | V2e |
| NOZZLE GROUP 51f | V2f |

Fig. 12

| | |
|---|---|
| NOZZLE ROW 9a | V1a |
| NOZZLE ROW 9b | V1b(<V1a) |
| NOZZLE ROW 9c | V1c(<V1b) |
| NOZZLE ROW 9d | V1d(<V1c) |

RECORDING APPARATUS AND METHOD FOR CONTROLLING THE SAME

CROSS REFERENCE TO RELATED APPLICATION

The present application claims priority from Japanese Patent Application No. 2017-072068, filed on Mar. 31, 2017, the disclosure of which is incorporated herein by reference in its entirety.

BACKGROUND

Field of the Invention

The present invention relates to a recording apparatus that discharges liquid droplets from a nozzle to perform recording on a recording medium and a method for controlling the recording apparatus.

Description of the Related Art

There is known a printer in which a discharge speed of ink droplets is changed according to a nozzle use rate. In this printer, the discharge speed of ink droplets for one nozzle is set lower when a use rate of said nozzle is higher than a certain threshold value compared to when the use rate of said nozzle is lower than the certain threshold value. When the use rate of said nozzle is low, the discharge speed of ink droplets is high, and two ink droplets discharged successively from said nozzle impact substantially simultaneously on a recording medium. When the use rate of said nozzle is high, the discharge speed of ink droplets is low, and two ink droplets discharged successively from said nozzle land on the recording medium after having been combined in midair. As a result, distortion of an image based on an air current accompanying discharge of ink droplets (wind ripple) is suppressed.

SUMMARY

A difference occurs in landing position of the ink droplets between when the discharge speed of ink droplets is fast and when it is slow. In the case of the above-described printer, the discharge speed differs according to the use rate of the nozzle, so there is a risk that when regions where use rates of nozzles differ are continuous, there occurs a lowering of image quality such as a white stripe where the ink droplets do not impact being generated, or a density unevenness occurring.

An object of the present teaching is to provide a recording apparatus capable of suppressing a lowering of image quality in a boundary portion of a region where a landing amount of ink droplets per unit area is large and a region where it is small, while also suppressing occurrence of wind ripple.

A first aspect of the present teaching provides a recording apparatus configured to perform recording to a recording medium by discharging liquid droplets from a head while moving the recording medium and the head relatively, the recording apparatus including: the head; and a controller, the controller being configured to: based on received image data, discriminate a first region and a second region on the recording medium, the first region and the second region being adjacent in a moving direction of the recording medium with respect to the head, the first region being a region where an amount of the liquid droplets to be landed per unit area is less than a certain amount, and the second region being a region where an amount of the liquid droplets to be landed per unit area is greater than or equal to the certain amount; set a boundary region that includes a boundary of the first region and the second region; set a first discharge speed for a discharge speed of liquid droplets from the head to be landed to a first main region, the first main region included in the first region and positioned on an opposite side to the second region with respect to the boundary region; set a second discharge speed slower than the first discharge speed for a discharge speed of the liquid droplets from the head to be landed to a second main region, the second main region included in the second region and positioned on an opposite side to the first region with respect to the boundary region; and set a discharge speed between the first discharge speed and the second discharge speed for a discharge speed of the liquid droplets from the head to be landed to the boundary region.

A second aspect of the present teaching provides a method for controlling a recording apparatus including a head and configured to perform a recording to a recording medium by discharging liquid droplets from the head while moving the recording medium and the head relatively, the method including: based on received image data, discriminating a first region and a second region on the recording medium, the first region and the second region being adjacent in a moving direction of the recording medium with respect to the head, the first region being a region where an amount of the liquid droplets to be landed per unit area is less than a certain amount, and the second region being a region where an amount of the liquid droplets to be landed per unit area is greater than or equal to the certain amount; setting a boundary region that includes a boundary of the first region and the second region; setting a first discharge speed for a discharge speed of liquid droplets from the head to be landed to a first main region, the first main region included in the first region and positioned on an opposite side to the second region with respect to the boundary region; setting a second discharge speed slower than the first discharge speed for a discharge speed of liquid droplets from the head to be landed to a second main region, the second main region included in the second region and positioned on an opposite side to the first region with respect to the boundary region; and setting a discharge speed between the first discharge speed and the second discharge speed for a discharge speed of liquid droplets from the head to be landed to the boundary region.

When performing recording on a region where an amount of liquid droplets to be landed per unit area is large, an air current generated by liquid droplets being discharged from the head is strong. Therefore, it is easy for a disturbance of air current to occur due to collision of an air current generated by relative movement of a recording medium and the head and an air current generated by liquid droplets being discharged from the head. When such a disturbance of air current occurs, there is a risk that a landing position of liquid droplets in the recording medium shifts.

According to an aspect of the present teaching, a discharge speed when performing recording to the second main region is decreased, hence the air current generated by liquid droplets being discharged from the head weakens. Therefore, it becomes difficult for the above-described disturbance of air current to occur. On the other hand, when performing recording to the first main region, the discharge speed is increased. Therefore, generation of mist can be suppressed to the utmost.

If, at this time, contrary to the present teaching, the discharge speed in a first region is set to a first discharge speed and the discharge speed in a second region is set to a second discharge speed without a boundary region being set, then the discharge speed changes sharply when changing from a state of liquid droplets being discharged in the first region to a state of liquid droplets being discharged in the second region. Therefore, there is a risk of a shift of landing position occurring in a boundary portion of the first region and the second region, whereby image quality lowers. Accordingly, in the present teaching, a boundary region including a boundary of the first region and the second region is set, and the discharge speed of the liquid droplets from the head to be landed to the boundary region is set to a value between the first discharge speed and the second discharge speed. As a result, a shift of landing position in the boundary portion of the first region and the second region can be suppressed.

BRIEF DESCRIPTION OF THE DRAWINGS

FIG. 12 is a view for explaining a relationship of each of nozzle rows and a first discharge speed in a sixth embodiment.

DESCRIPTION OF THE EMBODIMENTS

A first embodiment of the present teaching will be described below.

<Overall Configuration of Printer>

Figure 1:
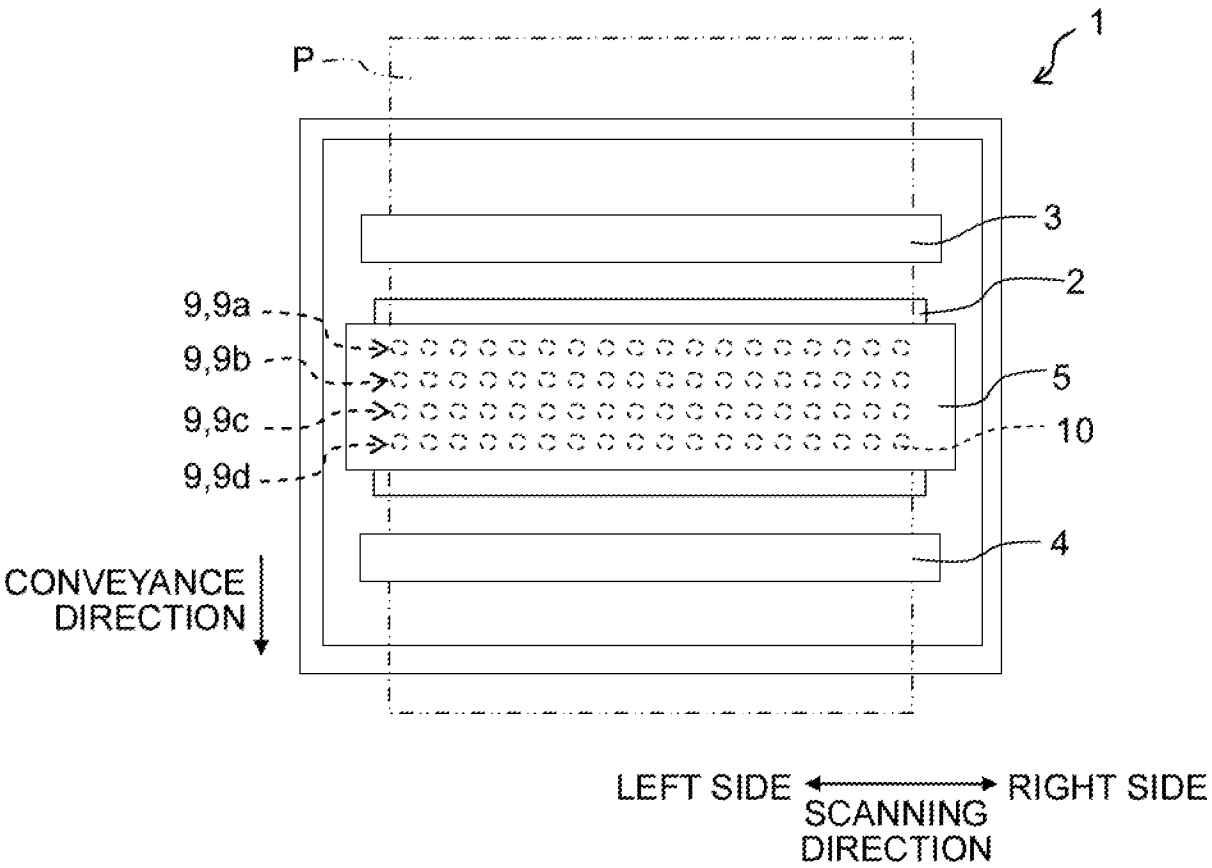
FIG. 1 is a schematic configurational view of a printer according to a first embodiment.

As depicted in FIG. 1, a printer 1 according to the first embodiment includes the likes of a platen 2, conveyance rollers 3, 4, and an ink-jet head 5 (a "head" of the present teaching).

The conveyance rollers 3, 4 convey a recording sheet P (a "recording medium" of the present teaching) in a conveyance direction. The platen 2 supports, from below, the recording sheet P conveyed by the conveyance rollers 3, 4. The conveyance roller 3 is disposed on an upstream side in the conveyance direction of the platen 2, and the conveyance roller 4 is disposed on a downstream side in the conveyance direction of the platen 2. The conveyance rollers 3, 4 are connected to a conveyance motor 26 (refer to FIG. 2) via an unillustrated gear, and so on. When the conveyance motor 26 is driven, the conveyance rollers 3, 4 rotate, and the recording sheet P is conveyed. A "conveyor" of the present teaching includes the conveyance rollers 3, 4 and the conveyance motor 26, of the present embodiment.

The ink-jet head 5 is disposed above the platen 2. A lower surface of the ink-jet head 5 is a discharge surface. A plurality of nozzles 10 open in the discharge surface, and ink droplets are discharged from the nozzles 10. The plurality of nozzles 10 form four nozzle rows 9 arranged in the conveyance direction. Each of the nozzle rows 9 extends in a scanning direction (a direction orthogonal to the conveyance direction; an "orthogonal direction" of the present teaching), over an entire width of the recording sheet P. The ink-jet head 5 is a so-called page-width head. The ink-jet head 5 (the page-width head) has a width larger than the width of the recording sheet P. The width of the ink-jet head 5 is along the recording sheet P to be printed by the ink-jet head 5 and is along the scanning direction orthogonal to the conveyance direction. Hereafter, the four nozzle rows 9 will sometimes be called nozzle rows 9*a*, 9*b*, 9*c*, 9*d* in order from the upstream side in the conveyance direction. Each of the nozzle rows 9*a*, 9*b*, 9*c*, 9*d* respectively discharges black, yellow, cyan, magenta ink droplets from the nozzles 10.

<Controller>

Figure 2:
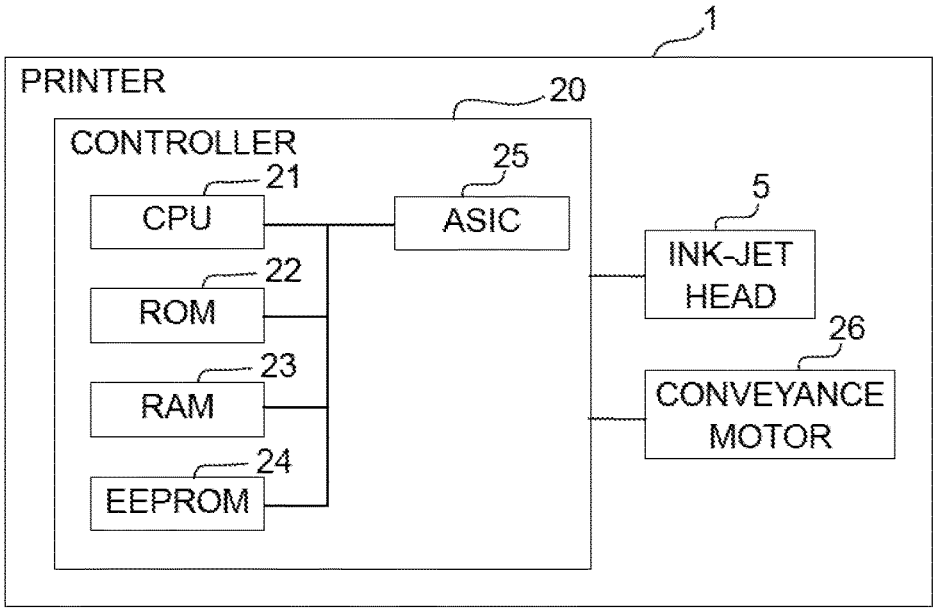
FIG. 2 is a block diagram showing an electrical configuration of the printer according to the first embodiment.

Operation of the printer 1 is controlled by a controller 20. As depicted in FIG. 2, the controller 20 is configured by the likes of a CPU (Central Processing Unit) 21, a ROM (Read Only Memory) 22, a RAM (Random Access Memory) 23, an EEPROM (Electrically Erasable Programmable Read Only Memory) 24, and an ASIC (Application Specific Integrated Circuit) 25, and controls operation of the ink-jet head 5 or the conveyance motor 26.

Note that the controller 20 may have only one CPU 21 as depicted in FIG. 2, and processing may be performed collectively by this one CPU 21. Alternatively, the controller 20 may have a plurality of CPUs 21 and processing may be performed in a shared manner by these plurality of CPUs 21. Moreover, the controller 20 may have only one ASIC 25 as depicted in FIG. 2, and processing may be performed collectively by this one ASIC 25. Alternatively, the controller 20 may have a plurality of ASICs 25 and processing may be performed in a shared manner by these plurality of ASICs 25.

<Control during Recording>

Incidentally, a landing position of the ink droplet shifts irregularly according to recording conditions. This is because a disturbance of air current occurs around the ink droplet. The following are regarded as generating factors of the disturbance of air current, namely: a conveyance speed of the recording sheet; a discharge frequency, a discharge amount (size), and a discharge speed of the ink droplets; an adjacent nozzle number being the number (in the scanning direction) of adjacent nozzles that simultaneously discharge; an arrangement pitch of the nozzles; a head gap (a distance between the discharge surface and the platen); and so on. Of these, essential conditions concerned with apparatus specifications of the printer 1 (for example, the conveyance speed, the discharge frequency, the arrangement pitch of the nozzles, and the head gap) cannot be used as a means of adjusting the landing position. Therefore, the discharge amount and discharge speed of the ink droplets and the adjacent nozzle number being the number of simultaneously discharging adjacent nozzles may be employed as the means for adjusting the landing position.

Now, the adjacent nozzle number causing the disturbance of air current has a close relationship with the arrangement pitch of the nozzles. This "causing adjacent nozzle number" is obtained in advance as an apparatus constant (threshold value). The controller 20 performs adjustment based on this "causing adjacent nozzle number". Note that the adjacent nozzle number refers to the number of nozzles adjacent to each other, of the nozzles simultaneously discharging during recording.

The adjacent nozzle number fixes other recording conditions and is obtained by parameterizing the amount of ink droplets. When the adjacent nozzle number is increased, irregular change of the landing position begins to be observed. The number at this time is the threshold value with respect to the adjacent nozzle number, and is the dividing line of generation/non-generation of a shift in position of landing. If the adjacent nozzle number is less than this number, the disturbance of air current does not occur.

Figure 3:
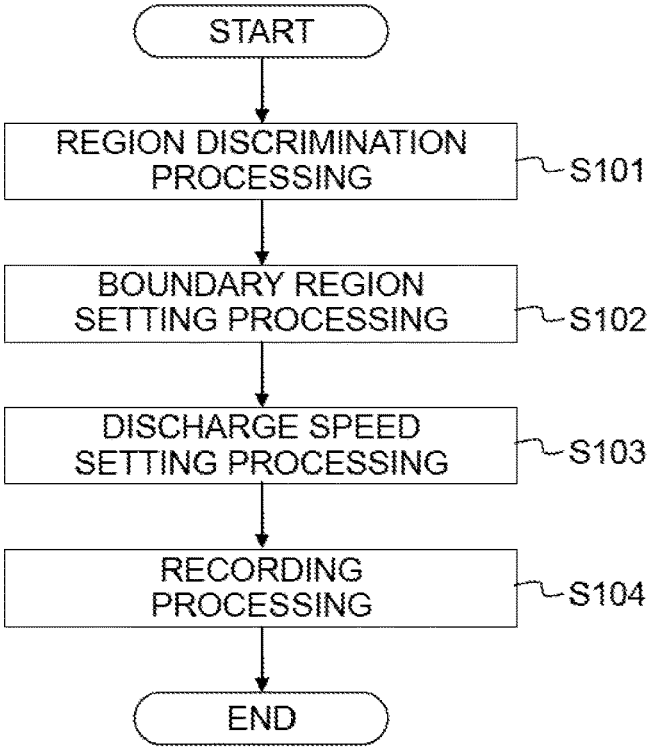
FIG. 3 is a flow chart showing control by a controller during recording.

Next, control during recording by the controller 20 will be described. In the present embodiment, the discharge speed of ink droplets is adopted as the adjustment means. The controller 20 advances each processing based on the flow chart of FIG. 3. This processing is carried out for each of the nozzle rows 9 (for each of the colors of inks).

When a recording command (data including image data) is inputted, the controller 20 performs region discrimination processing on an image formation region (S101). In this processing, the controller 20 discriminates a processing target region included in an image, based on the image data. The processing target region refers to a region formed by ink droplets discharged from a certain adjacent nozzle number (the causing adjacent nozzle number) or more of nozzles, as in the belt-shaped region of FIG. 4, for example. This region is a region whose adjacent nozzle number is larger compared to the "causing adjacent nozzle number".

Furthermore, the controller 20 partitions the processing target region into two kinds of regions (a first region 31 and a second region 32) with regard to the conveyance direction, based on the image data. The first region 31 is a region where a landing amount of ink droplets per unit area is less than a certain amount (a low density region), as in a region where duty is less than a certain value, for example. On the other hand, the second region 32 is a region where the landing amount of ink droplets per unit area is greater than or equal to the certain amount (a high density region), as in a region where duty is greater than or equal to the certain value, for example. Now, FIG. 4 depicts one second region 32 and two first regions 31 (first regions 31*a*, 31*b*) adjacent to this second region 32 sandwiching the second region 32 in the conveyance direction.

Next, the controller 20 executes boundary region setting processing (S102). As depicted in FIG. 4, a boundary region 33 that includes a boundary 34 of the first region 31 and the second region 32 and extends on both sides of that boundary 34, is set. Describing in more detail, the illustrated belt-shaped region includes two boundary regions 33*a*, 33*b*. Regarding the conveyance direction, the boundary region 33*a* on the downstream side is set from an end section on the downstream side of the second region 32 and an end section on the upstream side of the first region 31*a*, based on a boundary 34*a* on the downstream side. On the other hand, the boundary region 33*b* on the upstream side is set from an end section on the upstream side of the second region 32 and an end section on the downstream side of the first region 31*b*, based on a boundary 34*b* on the upstream side. At this time, a width (a length in the conveyance direction) L1 of the boundary region 33*a* is the same length as a width L2 of the boundary region 33*b*.

Next, the controller 20 executes discharge speed setting processing (S103). In the discharge speed setting processing, the discharge speeds during recording are respectively set for the discriminated two regions 31, 32 and the set boundary region 33. The discharge speed with regards to the second region 32 is set lower compared to the discharge speed with regards to the first region 31. An intermediate speed of those of the two regions 31, 32 is set with regards to the boundary region 33. The ink droplets are respectively discharged at the set discharge speeds onto the first region 31, the second region 32, and the boundary region 33.

Figure 4:
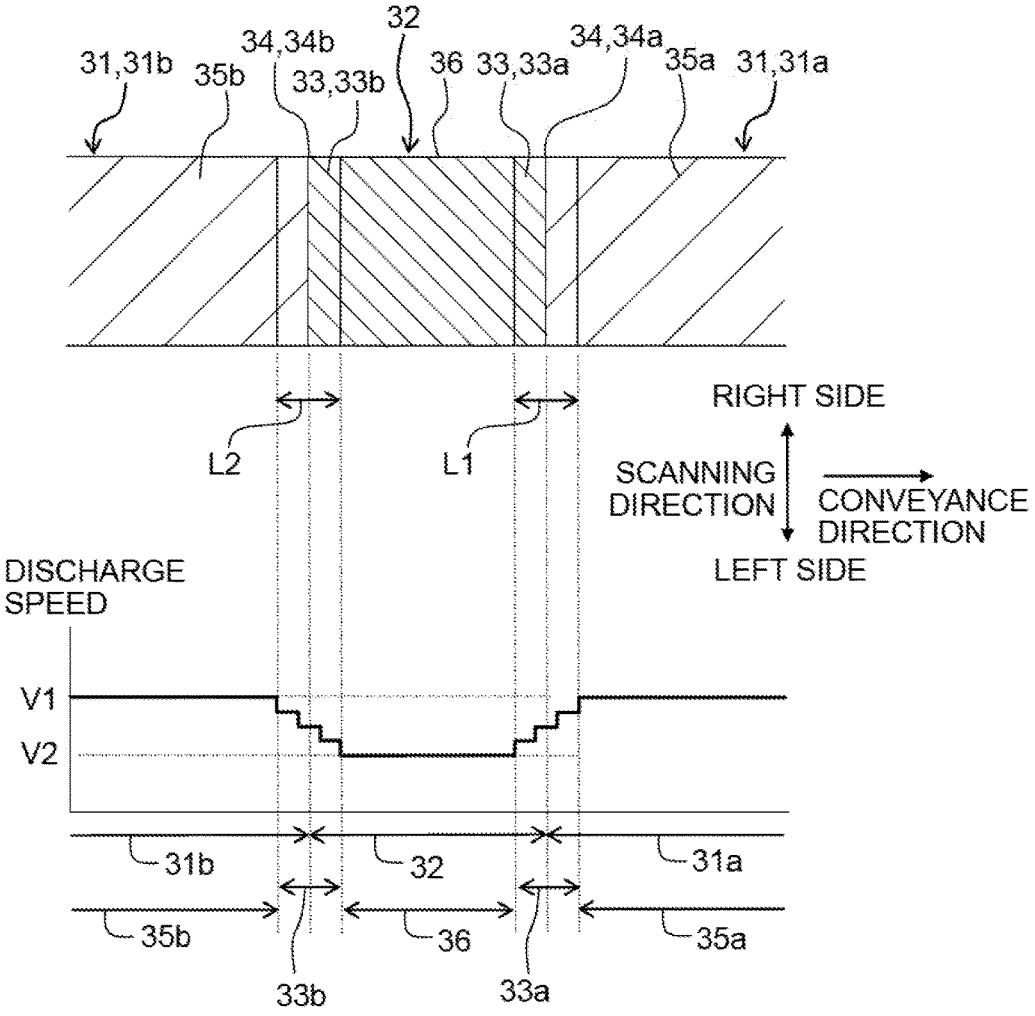
FIG. 4 is a view for explaining a first region, a second region, and a boundary region, and a discharge speed in each of the regions, in the first embodiment.

Describing in more detail, as depicted in FIG. 4, in a region 35*a* (an exemplary first main region of the present teaching) more on the downstream side (on an opposite side to the second region 32) than the boundary region 33*a*, of the first region 31*a*, and a region 35*b* (another exemplary first main region of the present teaching) more on the upstream side (on an opposite side to the second region 32) than the boundary region 33*b*, of the first region 31*b*, the discharge speed is set to a first discharge speed V1 (for example, 10 m/s). Moreover, in a region 36 (an exemplary second main region of the present teaching) between (on opposite sides to the first regions 31*a*, 31*b* of) the boundary region 33*a* and the boundary region 33*b*, of the second region 32, the discharge speed is set to a second discharge speed V2 (for example, 6 m/s). Note that regarding a region of less than the certain adjacent nozzle number and that has not been discriminated by region discrimination processing, of the image to be recorded, the discharge speed of that region is set to the first discharge speed V1.

Moreover, in the boundary region 33*a*, the discharge speed is set to a discharge speed between the first discharge speed V1 and the second discharge speed V2. In the boundary region 33*a*, the discharge speed gradually slows with increasing location to the upstream side in the conveyance direction. In the boundary region 33*b* also, the discharge speed is set to a discharge speed between the first discharge speed V1 and the second discharge speed V2. In the boundary region 33*b*, the discharge speed gradually quickens with increasing location to the upstream side in the conveyance direction. In the present embodiment, the discharge speed in both boundary regions 33*a*, 33*b* changes in a four-stage stepped manner. Note that this change may be more multi-staged, or may be a single stage of the intermediate speed.

Next, the controller 20 executes recording processing (S104). In the recording processing, the controller 20 controls the ink-jet head 5 to discharge ink droplets from the plurality of nozzles 10, while controlling the conveyance motor 26 to convey the recording sheet P by the conveyance rollers 3, 4. At this time, the ink droplets are discharged from the nozzles 10 at the set discharge speeds, towards each of the regions of the recording sheet P. Note that the recording sheet P undergoes recording in order from the downstream side in the conveyance direction.

Now, an air current in the conveyance direction is generated above the conveyed recording sheet P. Moreover, when the ink droplets are discharged, the air moves along with the flying ink droplets. In a region where the landing amount of ink droplets per unit area is large, ink droplets are discharged simultaneously from a large number of the nozzles 10 or ink droplets are discharged continuously from each of the nozzles 10. Therefore, an air current along a flight path of the ink droplets occurs. As a result, an air current generated by conveyance of the recording sheet P and an air current generated by discharge of the ink droplets, collide. There is a risk that a large disturbance of air current occurs in a direction along the discharge surface and that the landing position of the ink droplets shifts. The disturbance of air current moves irregularly, and the landing position depicts a time-dependent shift.

To counter this, in the second region 32 where the landing amount is large, a lower discharge speed is set, compared to the discharge speed indicated by the image data. As a result, the air current accompanying discharge of the ink droplets weakens, and a density unevenness due to the disturbance of air current is suppressed. However, at the boundary 34 with the adjacent first region 31, a change in discharge speed is large, and there is a risk that a striped density unevenness along a boundary line occurs.

Now, there is a tendency that the larger the discharge speed is, the closer to directly below a nozzle opening the ink droplets land. If the above-mentioned discharge speed setting processing is not performed, then at the boundary 34*a*, the discharge speed changes from "small" to "large" as recording proceeds. Fellow dots separate, causing concern about generation of a white stripe. Conversely, at the boundary 34*b*, the discharge speed changes from "large" to "small", hence a dark colored stripe sometimes occurs due to proximity of fellow dots.

Accordingly, in the present embodiment, a recording region is divided into two regions 31, 32. A region where manifestation of an air current disturbance is predicted, of these two regions 31, 32, has its discharge speed during recording adjusted. Specifically, the region has its discharge speed during recording changed from the discharge speed V1 (for example, 10 m/s) indicated by the image data, to the smaller discharge speed V2 (for example, 6 m/s). Furthermore, the boundary region 33 is provided as a countermeasure to the density unevenness caused by the change in discharge speed. In the boundary region 33, the discharge speed is set to an intermediate speed of the discharge speeds in the two regions 31, 32.

Incidentally, the above-mentioned disturbance of air current does not occur immediately after switching of the region, and becomes obvious in a portion where recording has advanced by 10 to 20 dots of the second region 32. Accordingly, in the boundary region 33, a dot number in the conveyance direction belonging to the second region 32 (a width on a second region 32 side) is set to not more than 15 dots. As a result, in the second region, generation of the disturbance of air current is suppressed, and the density unevenness caused by the disturbance of air current is suppressed. Furthermore, in boundary portions of the first region 31 and the second region 32, there is no large speed change, hence the density unevenness caused by the large speed change is also suppressed.

Moreover, in the present embodiment, the discharge speed is changed gradually in the boundary regions 33*a*, 33*b*. As a result, in the boundary portion of the first region 31 and the second region 32, lowering of image quality can be more effectively suppressed.

Moreover, if it is only a matter of making disturbance of air current difficult to occur, all that is required is to set the discharge speed for all regions to the second discharge speed V2. However, there is concern that by slowing the discharge speed, a generated amount of ink mist increases. This is because, although it depends also on the head gap, if the discharge speed is small, then it becomes impossible to maintain a speed at which the recording sheet P can be reached. In the present embodiment, the discharge speed with regards to the first region 31 other than the boundary region 33 (regions 35*a*, 35*b*) is set to the first discharge speed V1. This discharge speed is larger than the second discharge speed V2 of the second region 31 other than the boundary region 33 (region 36). To that extent, a mist generation amount is suppressed, and an inside of the printer 1 is never contaminated by ink.

Next, a second embodiment of the present teaching will be described.

There is a risk that during recording of the image, density of the image changes when the discharge speed of ink droplets changes. This phenomenon occurs when a plurality of ink droplets (for example, a main droplet 41 and a satellite droplet 42) are discharged simultaneously. This density change is explained from a relationship of the discharge speed and sizes and landing positions of both droplets.

Describing in more detail, when the ink droplet divides into a plurality of droplets, the satellite droplet 42 of small size occurs. The size of the satellite droplet 42 is smaller when the discharge speed is large than when the discharge speed is small. The smaller the size of the droplet is, the more strongly it receives a resistance from the air during flight. Therefore, a form of the dot formed by the ink droplet differs according to the discharge speed of that ink droplet.

Figure 5A:
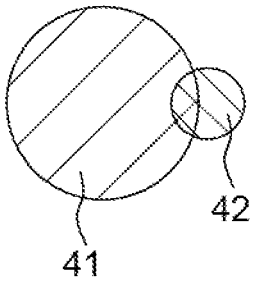
FIG. 5A is a view for explaining a landing position of a main liquid droplet and a satellite liquid droplet when the discharge speed is slow.
Figure 5B:
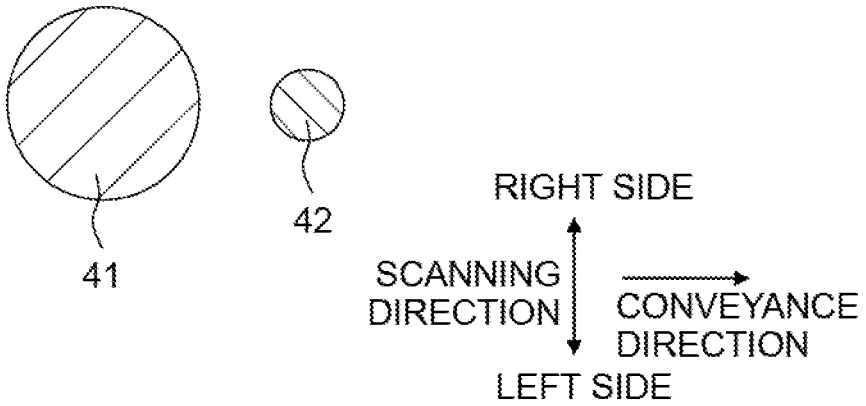
FIG. 5B is a view for explaining the landing position of the main droplet and the satellite droplet when the discharge speed is fast.

For example, it is assumed that one ink droplet divides into two droplets. When the discharge speed is small, the size of the satellite droplet 42 is larger compared to when the discharge speed is large. Therefore, deceleration during flight of the satellite droplet 42 is small and a speed difference of the two droplets 41, 42 is small. The smaller the discharge speed is, the smaller a distance between centers of dots formed by the two droplets becomes. When the discharge speed is small, the dots formed by both droplets 41, 42 overlap, as depicted in FIG. 5A. When the discharge speed is large, the dots formed by both droplets 41, 42 do not overlap, as depicted in FIG. 5B. A coverage ratio of a sheet surface is smaller when the dots overlap than when the dots do not overlap. As a result, in the second region 32, density of the recorded image falls below density indicated by the image data.

Figure 6:
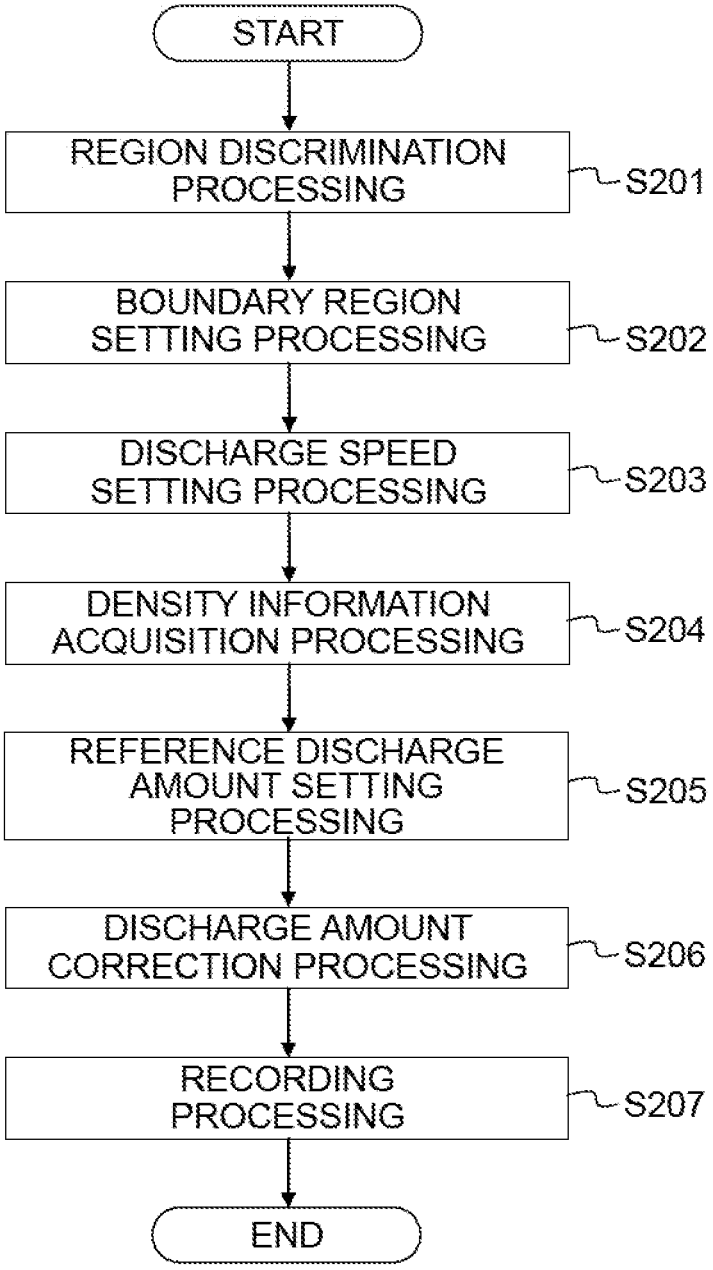
FIG. 6 is a flow chart showing control by a controller during recording in a second embodiment.

In the present embodiment, a measure is taken to counter density lowering of the second region 32. The discharge amount of ink droplets is adopted as the adjustment means, in addition to the discharge speed. The controller 20 advances each processing according to a flow of FIG. 6.

First, steps S201 to S203 are performed similarly to steps S101 to S103 of the first embodiment. The recording region undergoes region division (into the first region 31 and the second region 32), at two different discharge speeds V1, V2. Those discharge speeds are set for each dot. In the boundary region 33 between the first region 31 and the second region 32, an intermediate speed is set in stages, with respect to the two speeds V1, V2.

Next, the controller 20 performs density information acquisition processing (S204). The controller 20 acquires density information of each dot configuring the image, from the image data.

Next, the controller 20 performs reference discharge amount setting processing (S205). The controller 20 sets the discharge amount of ink droplets (the discharge amount indicated by the image data; corresponds to a reference discharge amount) for each dot, based on the obtained density information. At this time, a drive waveform corresponding to the discharge amount is allocated. If the ink-jet head 5 is driven by this drive waveform, ink droplets of an amount indicated by the image data are discharged at a time of the first discharge speed. A configuration may be adopted where the discharge amount at the first discharge speed V1 itself is allocated in place of the drive waveform.

Figure 7:
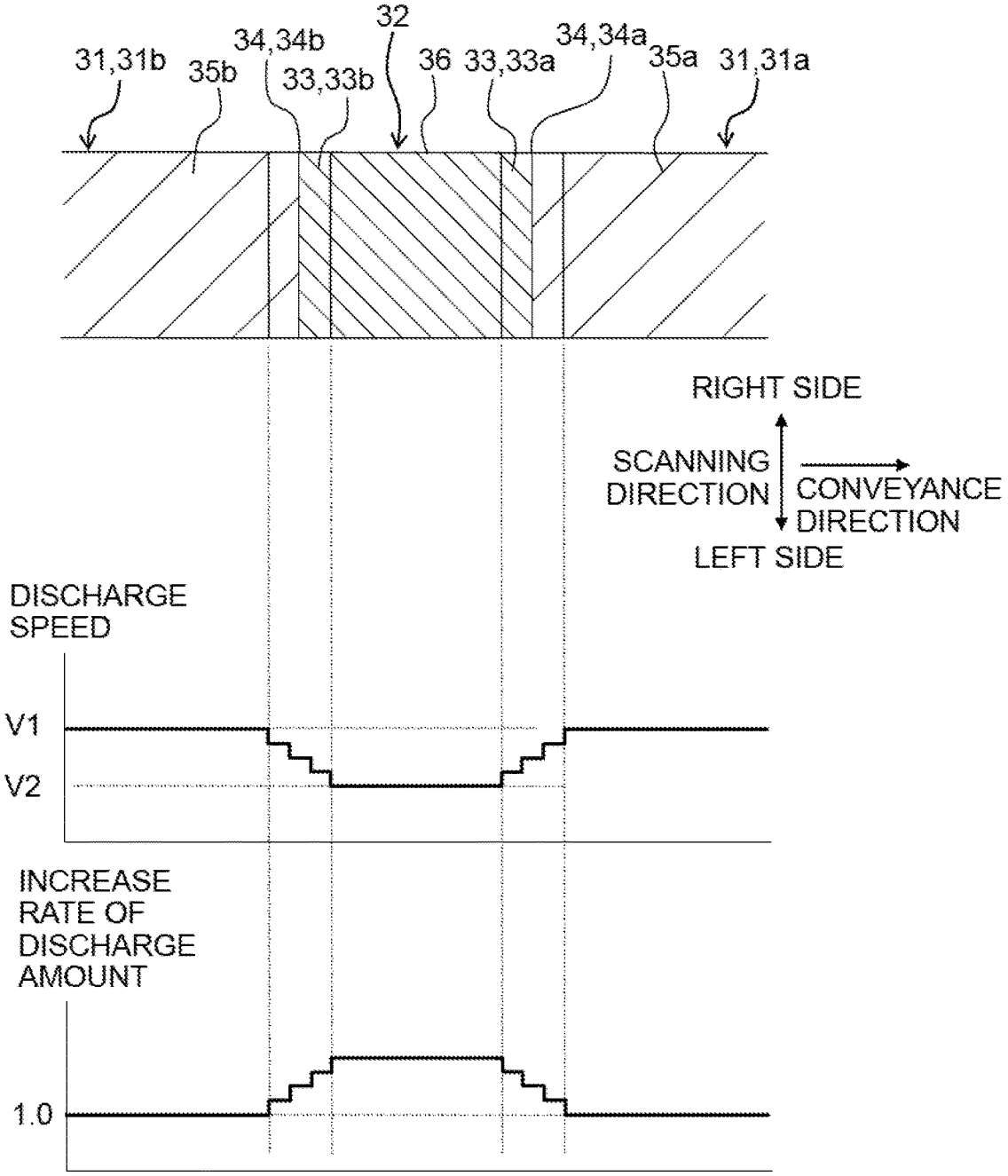
FIG. 7 is a view for explaining a first region, a second region, and a boundary region, and a discharge speed and a discharge amount in each of the regions, in the second embodiment.
Figure 8:
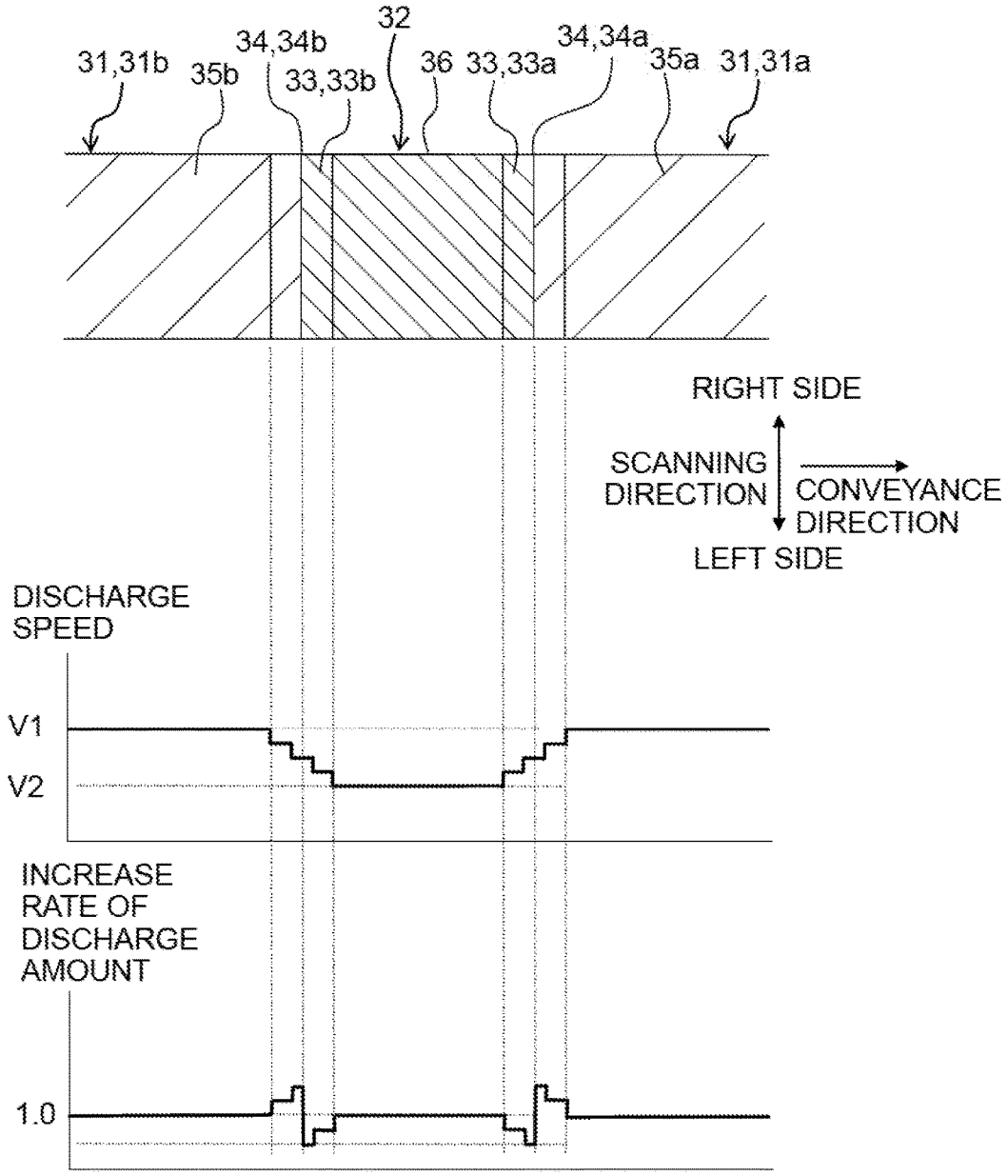
FIG. 8 is a view for explaining a first region, a second region, and a boundary region, and a discharge speed and a discharge amount in each of the regions, in a third embodiment.

Furthermore, the controller 20 performs discharge amount correction processing (S206). The controller 20 compares the discharge speed set in step S203 and the first discharge speed V1 for each dot. The reference discharge amount is corrected so that the slower the discharge speed becomes with respect to the first discharge speed V1, the more the discharge amount of ink droplets is increased. Correction of the reference discharge amount is performed by changing the drive waveform, for example. Alternatively, if there are a plurality of kinds of discharge amounts of ink droplets dischargeable, the kind of ink droplet corresponding to the discharge amount of ink droplets after correction is changed. The lower part of FIG. 7 depicts a processing result. The vertical axis is a ratio of the corrected discharge amount to the reference discharge amount (the discharge amount indicated by the image data). That is, the vertical axis is a rate of increase of the discharge amount.

Then, the controller 20 executes discharge processing (S207). Ink droplets of the discharge amount corrected in step S206 are discharged from the nozzle 10 at the discharge speed set in step S203. In the present embodiment, the slower the discharge speed a region has, the more the discharge amount of ink droplets increases in relation to the reference discharge amount, hence the coverage ratio with regards to the recording sheet P is improved. As a result, although discharge speeds differ between regions, the image is recorded at the density indicated by the image data over an entire region of the recording region.

Now, in the present embodiment, the discharge amount when the discharge speed was the first discharge speed V1 was determined as the reference discharge amount, and a correction in which the slower the discharge speed became with respect to the first discharge speed V1, the more the determined reference discharge amount was increased, was performed. However, the present teaching is not limited to this. For example, it is possible that the discharge amount when the discharge speed is the second discharge speed V2 is determined as the reference discharge amount, and that a correction in which the faster the discharge speed becomes with respect to the second discharge speed V2, the more the determined reference discharge amount is decreased, is performed.

Next, a third embodiment of the present teaching will be described. In the present embodiment also, similarly to in the second embodiment, the controller 20 executes processing in accordance with the flow depicted in FIG. 6. However, a way of correction in the discharge amount correction processing (S206) differs from in the second embodiment. Correction is carried out only on the boundary region 33.

In the present embodiment, in the discharge amount correction processing (S206 of FIG. 6), comparison of speeds is performed only on dots within the boundary region 33. For dots on a first region side in relation to the boundary 34, the slower than the first discharge speed V1 their discharge speed is, the more the discharge amount is increased from the reference discharge amount. Density of the recorded image approaches densities of the regions 35*a*, 35*b*. On the other hand, for dots on a second region side in relation to the boundary 34, the faster than the second discharge speed V2 their discharge speed is, the more the discharge amount is decreased from the reference discharge amount. Density of the recorded image approaches density of the region 36.

In this case, density of the region 36 is lower than the density indicated by the image data. This is because regardless of a small discharge speed (the second discharge speed V2) having been set in this region 36 in the discharge speed setting processing (S203), the discharge amount correction processing (S206) is not carried out. However, density unevenness in the conveyance direction is suppressed.

Next, a fourth embodiment of the present teaching will be described. In the present embodiment, the density unevenness in the boundary region is moderated without a correction like that of the discharge amount correction processing (S206) being performed. The adjustment means is discharge speed. Similar to in the first embodiment, the controller 20 executes processing in accordance with the flow of FIG. 3. The present embodiment has a feature in a way of setting in the discharge speed setting processing (S103). For the second region, setting of the discharge speed becomes finer in the scanning direction.

Figures 9A, 9B:
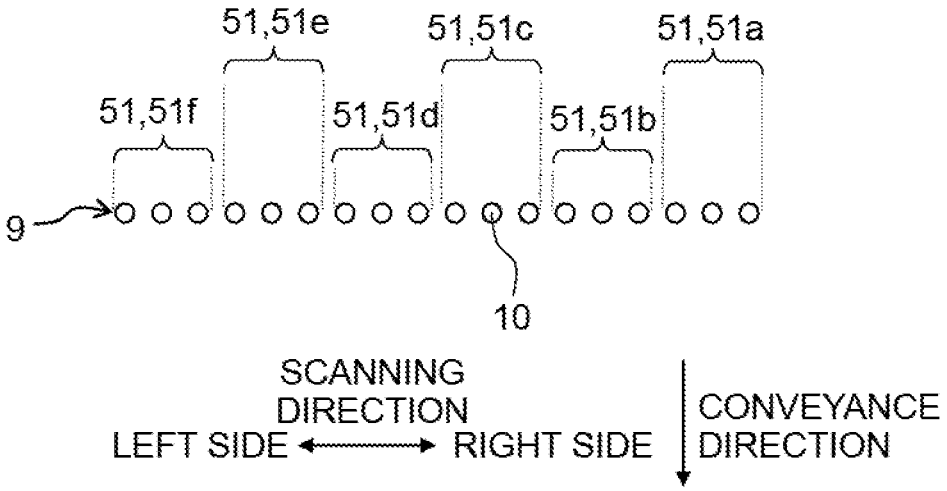
FIG. 9A is a view for explaining a nozzle group in a fourth embodiment.
FIG. 9B is a view for explaining a relationship of each of the nozzle groups and a second discharge speed in the fourth embodiment.

In the discharge speed setting processing (S103), the controller 20 sets nozzle groups 51 for the plurality of nozzles 10 that are a target of this processing. The nozzles 10 forming the boundary 34 are the target. An example is depicted in FIG. 9A. One nozzle group 51 is configured by every three nozzles 10 lined up in the scanning direction. Six nozzle groups 51*a* to 51*f* are depicted in FIG. 9A. As depicted in FIG. 9B, mutually differing second discharge speeds V2 (V2*a* to V2*f*) are set in each of the nozzle groups 51*a* to 51*f*. Although these second discharge speeds V2*a* to V2*f* are mutually differing values, they are also mutually close values. All are greater than or equal to 6 m/s and less than 10 m/s.

Note that the number of nozzles configuring one nozzle group need not be three, and may differ for each nozzle group. When the discharge speed V2 is different for each of the nozzle groups 51*a* to 51*f*, there is concern about a visible density difference occurring between corresponding recording regions. Therefore, the number of nozzles configuring one nozzle group is a number sufficient to make the density difference visibly unrecognizable. Moreover, there may be fewer kinds of second discharge speeds V2, compared to the number of nozzle groups. It is only required that speeds differ from each other between adjacent nozzle groups.

In the boundary region 33, the discharge speed changes in steps. The number of steps until speed change finishes differs for each of the nozzle groups 51. A range (a length) of the density unevenness along the conveyance direction differs in the scanning direction. Therefore, when the image is viewed in entirety, the density unevenness is inconspicuous. Furthermore, in the region 36, recording is made at a plurality of second discharge speeds V2 (V2*a* to V2*f*) greater than or equal to 6 m/s. If the image is viewed in entirety, an average recording density is higher compared to when the second discharge speeds V2 have been standardized to 6 m/s. Therefore, a density difference of the region 36 and the boundary region 33 narrows, and the density unevenness becomes more inconspicuous.

In the present embodiment, the plurality of nozzles 10 forming the boundary 34 were divided into the plurality of nozzle groups 51, and the second discharge speed V2 was set for each of the nozzle groups 51. However, the present teaching is not limited to this. The second discharge speed V2 may be set individually for each of the nozzles 10. In this case, it is only required that setting is made so that the second discharge speeds V2 differ between adjacent nozzles 10.

Figure 10:
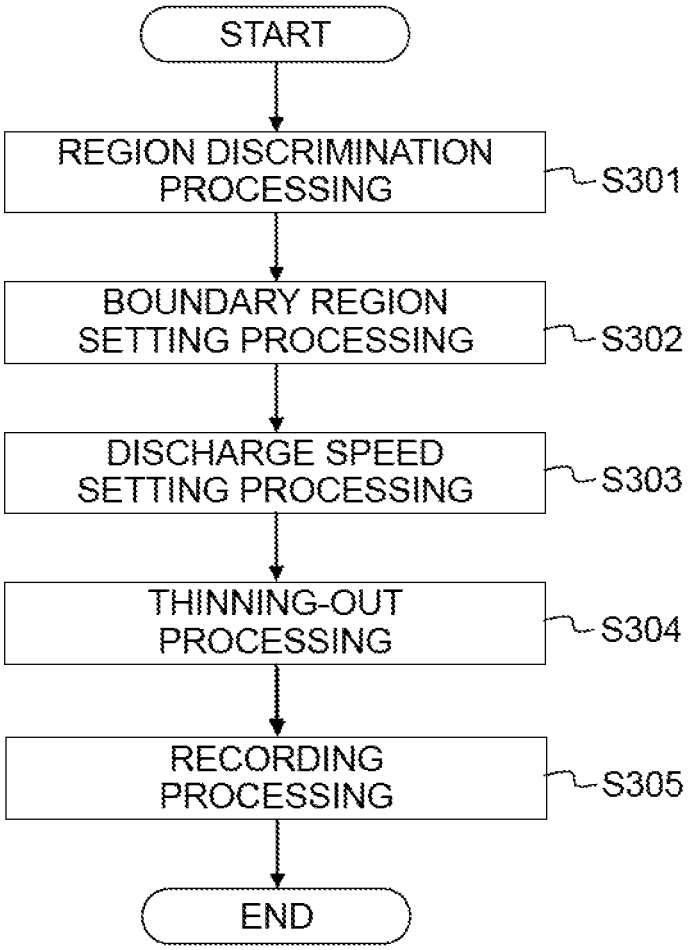
FIG. 10 is a flow chart showing control by a controller during recording in a fifth embodiment.

Next, a fifth embodiment of the present teaching will be described. In the present embodiment, the density unevenness in the boundary region is moderated without a correction like that of the discharge amount correction processing (S206) being performed. The adjustment means is the number of simultaneously discharging adjacent nozzles. The controller 20 executes processing in accordance with a flow of FIG. 10. Steps S301 to S303 correspond to steps S101 to S103 of the first embodiment.

Figure 11:
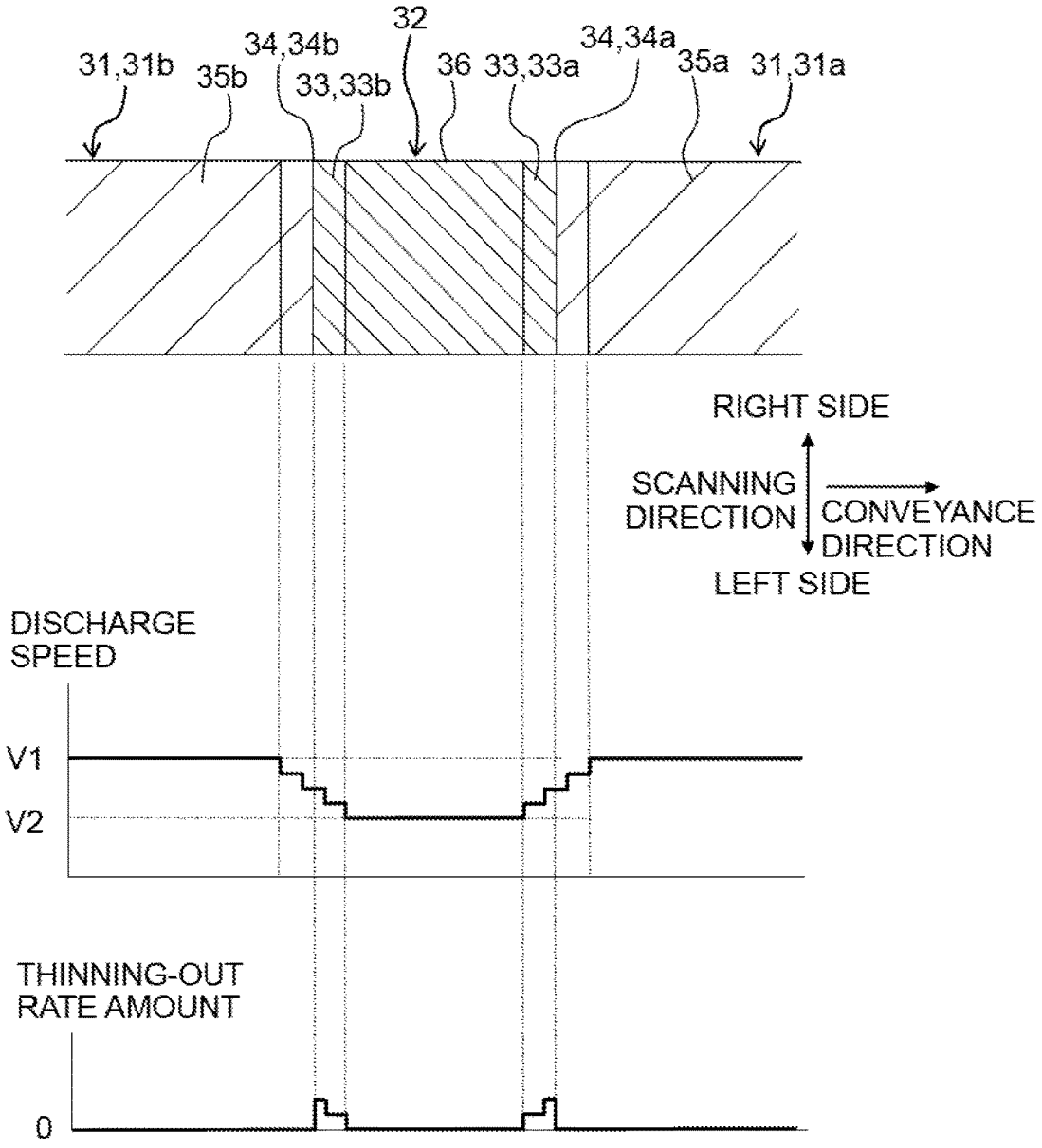
FIG. 11 is a view for explaining a first region, a second region, and a boundary region, and a discharge speed and a thinning-out rate in each of the regions, in the fifth embodiment.

Next, the controller 20 executes thinning-out processing (S304). In the thinning-out processing, the controller 20 thins out data of some of the dots from the image data corresponding to the second region 32 configuring the boundary region 33. At this time, as depicted in FIG. 11, the faster the discharge speed is with respect to the second discharge speed, the larger a thinning-out rate of the data is made. Note that thinning-out processing is not carried out on (the thinning-out rate is set to zero for) the image data corresponding to the first region 31 and the region 36.

Subsequently, the controller 20 executes discharge processing (S305). As a result, differences in density due to differences in discharge speeds are reduced, and the above-mentioned kind of density unevenness along the conveyance direction can be suppressed in the recorded image. Moreover, in the case where the thinning-out rate is changed according to the discharge speed as in the present embodiment, it is only required to carry out mask processing on the image data, hence control is easy.

Next, a sixth embodiment of the present teaching will be described. In the present embodiment, as depicted in FIG. 12, first discharge speeds V1 (first discharge speeds V1*a* to V1*d*) are individually set for the four nozzle rows 9*a* to 9*d*. At this time, V1*a*>V1*b*>V1*c*>V1*d* holds. That is, the more to a downstream side in the conveyance direction a nozzle row 9 is located, the lower its first discharge speed V1 is set.

Note that regarding the nozzle rows 9*a* to 9*d* in the present embodiment, the nozzle row 9 positioned on a downstream side in the conveyance direction, of adjacent two nozzle rows 9 corresponds to a "first nozzle row" of the present teaching, and the nozzle row 9 positioned on an upstream side in the conveyance direction, of adjacent two nozzle rows 9 corresponds to a "second nozzle row" of the present teaching. For example, regarding a relationship of the nozzle rows 9*a* and 9*b*, the nozzle row 9*b* positioned on the downstream side in the conveyance direction corresponds to the "first nozzle row" of the present teaching, and the nozzle row 9*a* positioned on the upstream side in the conveyance direction corresponds to the "second nozzle row" of the present teaching.

Now, due to an air current accompanying conveyance of the recording sheet and an air current accompanying discharge of ink droplets, a composite air current of the two (the disturbance of air current) occurs in the head gap. The composite air current is an air current having a complex flow. Its effect is felt more strongly with increasing location to the downstream side in the conveyance direction. Moreover, the composite air current is also a factor disturbing the landing position. Accordingly, in the present embodiment, the more to the downstream side in the conveyance direction a nozzle row 9 is, the lower its first discharge speed V1 is set. As a result, the air current accompanying discharge of ink droplets weakens with increasing location to the downstream side in the conveyance direction, and the composite air current also does not get too strong with increasing location to the downstream side in the conveyance direction. As a result, shifts in landing positions of the ink droplets among the nozzle rows 9, can be suppressed.

Figure 13:
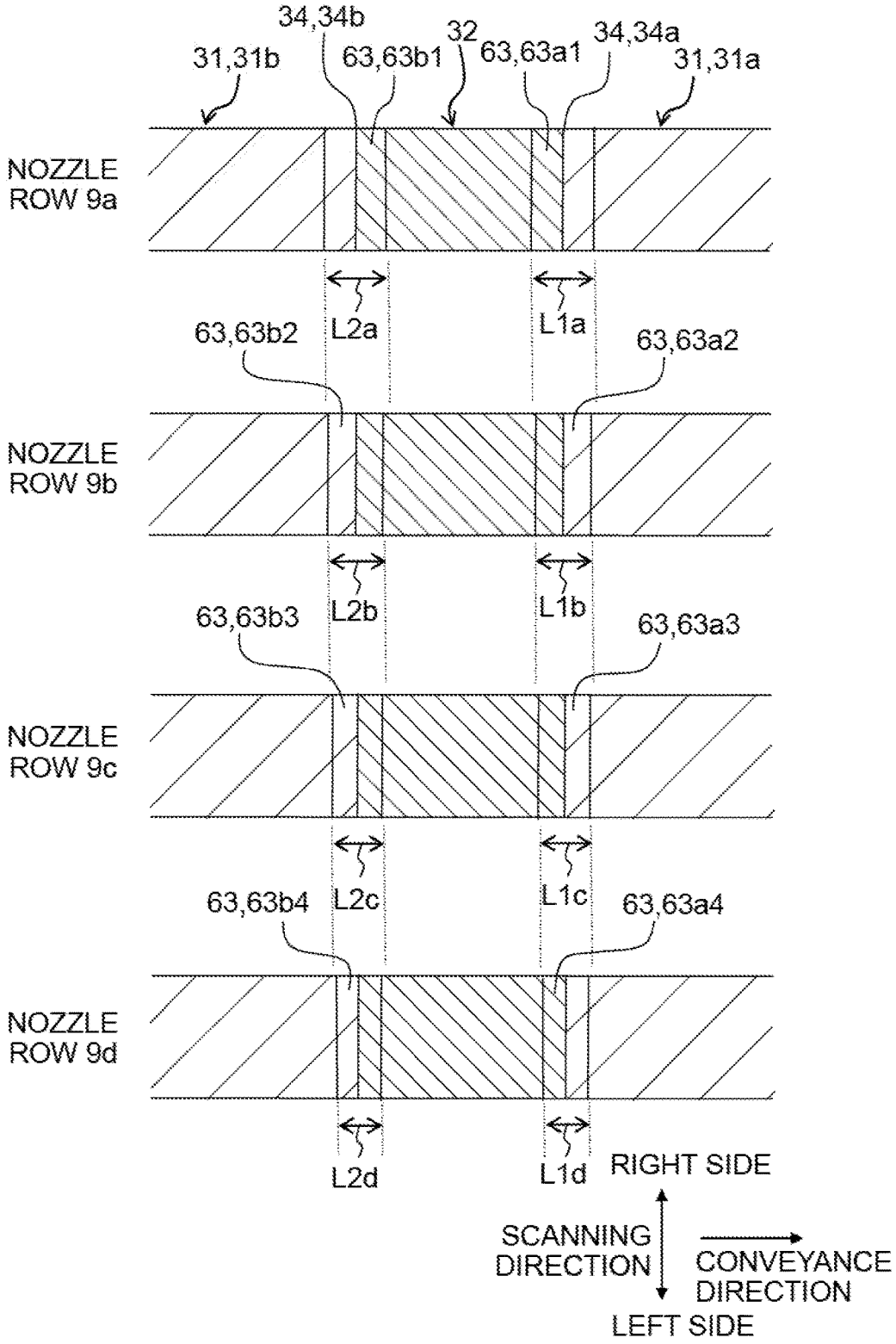
FIG. 13 is a view for explaining a boundary region for each of nozzle columns in a seventh embodiment.

Next, a seventh embodiment of the present teaching will be described. In the present embodiment, as depicted in FIG. 13, boundary regions 63 (boundary regions 63*a*1, 63*b*1, 63*a*2, 63*b*2, 63*a*3, 63*b*3, 63*a*4, 63*b*4) are individually set for the four nozzle rows 9*a* to 9*d*. At this time, the boundary region 63 is set for each of the nozzle rows 9 so that the more to the downstream side in the conveyance direction the nozzle row 9 is located, the shorter a width of its boundary region 63 becomes. That is, the boundary regions 63*a*1 to 63*a*4 are set so that widths L1*a* to L1*d* of the boundary regions 63*a*1 to 63*a*4 satisfy a magnitude relationship of L1*a*>L1*b*>L1*c*>L1*d*. Moreover, the boundary regions 63*b*1 to 63*b*4 are set so that widths L2*a* to L2*d* of the boundary regions 63*b*1 to 63*b*4 satisfy a magnitude relationship of L2*a*>L2*b*>L2*c*>L2*d*.

As explained in the sixth embodiment, due to an air current accompanying conveyance of the recording sheet and an air current accompanying discharge of ink droplets, a composite air current of the two (the disturbance of air current) occurs in the head gap. An effect of the composite air current is felt more strongly, the more to the downstream side in the conveyance direction the nozzle row 9 is located.

Accordingly, in the present embodiment, the more to the downstream side in the conveyance direction the nozzle row 9 is located, the shorter the width of its boundary region 63 is set. In this case, switching of the discharge speed is completed in a short time, and it is possible to shift to a region not generating a strong composite air current, before the composite air current gets too strong. As a result, shifts in landing positions of the ink droplets discharged from the nozzles 10, among the nozzle rows 9, can be suppressed.

Figure 14A:
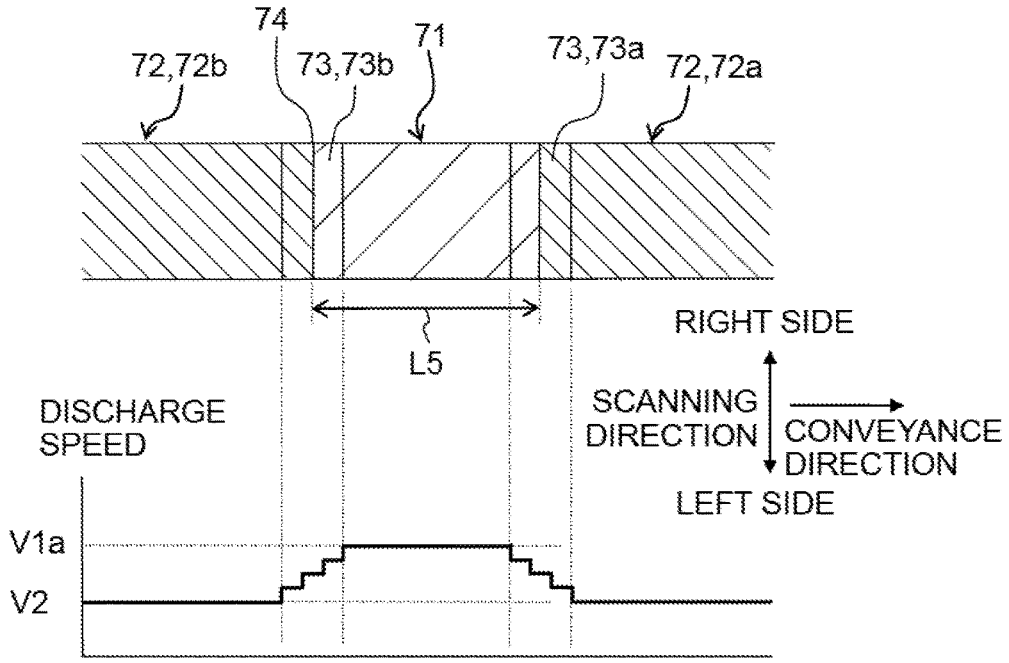
FIG. 14A is a view for explaining a first region, a second region, and a boundary region, and a discharge speed in each of the regions, when a length of the first region between two second regions is long, in an eighth embodiment.
Figure 14B:
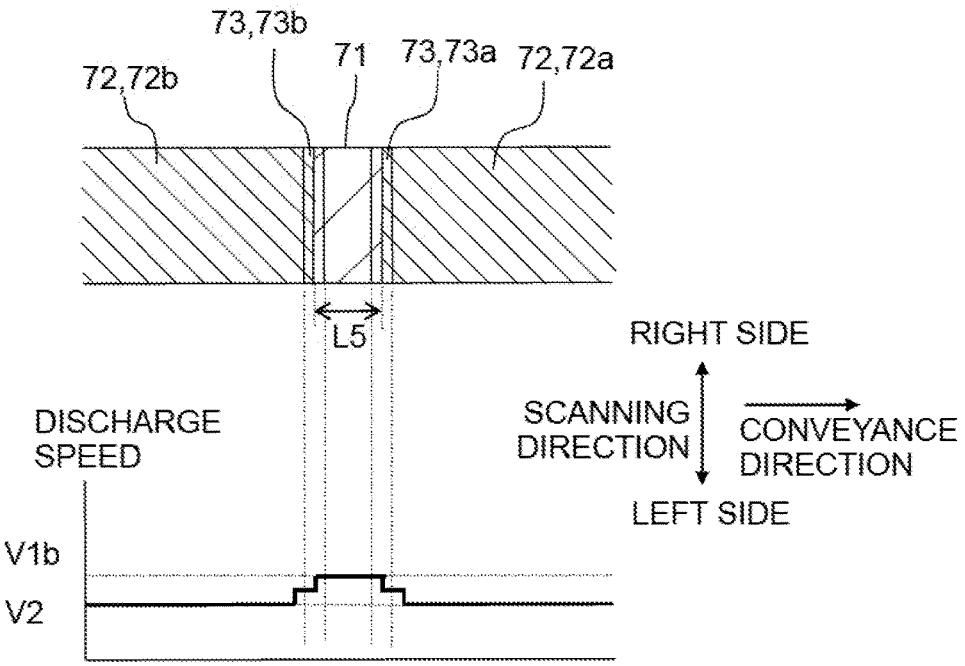
FIG. 14B is a view for explaining the first region, the second region, and the boundary region, and the discharge speed in each of the regions, when the length of the first region between two second regions is short, in the eighth embodiment.

Next, an eighth embodiment of the present teaching will be described. In the present embodiment, the discharge speed in a narrow region is adjusted in order to prevent an effect of the composite air current (the disturbance of air current) being exerted on a region on an upstream side in the conveyance direction straddling the narrow region. As depicted in FIG. 14, one first region 71 is sandwiched by two second regions 72. Regarding the conveyance direction, as depicted in FIG. 14A, when a length L5 of the first region 71 is greater than or equal to a certain length L0, the first discharge speed is set to V1*a*. On the other hand, as depicted in FIG. 14B, when the length L5 of the first region 71 is less than the certain length L0, the first discharge speed is set to V1*b* (<V1*a*).

In the second region 72, a landing amount is large, and compared to in the first region 71 where the landing amount is less than a certain amount, the air current accompanying discharge is strong. Even after discharge stop, this air current continues for a while. Therefore, if the first region 71 is narrow, then an effect of a composite air current that has occurred in a second region 72*a* on a downstream side in the conveyance direction is substantially received in a second region 72*b* on an upstream side in the conveyance direction. If the discharge speed V1 in the first region 71 is large, then the received effect also becomes large.

Accordingly, in the present embodiment, there is a threshold value L0 with respect to the length L5 in the conveyance direction of the first region 71. Moreover, as the first discharge speed V1 of the first region 71, the first discharge speed V1*b* of the first region 71 when L5<L0 is set to a smaller value compared to the first discharge speed V1*a* of the first region 71 when L5≥L0. As a result, the effect of the composite air current transmitted from the downstream side to the upstream side weakens. As a result, a shift of landing position is suppressed in the second region 72*b*.

Next, a ninth embodiment of the present teaching will be described. In the present embodiment, similarly to in the fourth embodiment, the plurality of nozzles 10 forming a boundary 84 are divided into the plurality of nozzle groups 51 aligned in the scanning direction. Moreover, in the region discrimination processing (refer to FIG. 3), a first region 81 and a second region 82 are discriminated for each nozzle group 51. Moreover, in the boundary region setting processing (refer to FIG. 3), a boundary region 83 is set for each nozzle group 51. At this time, a width of the boundary region 83 corresponding to a certain nozzle group 51 is determined by a positional relationship of the boundary 84 corresponding to this nozzle group 51 and the first region 81 and second region 82 corresponding to the nozzle group 51 adjacent to this nozzle group 51.

Setting of the boundary region 83 in the present embodiment will be described in more detail. Hereafter, setting of the boundary regions 83 corresponding to adjacent two nozzle groups 51*a*, 51*b*, of the plurality of nozzle groups 51 will be described, but the same applies also to setting of the boundary regions 83 corresponding to adjacent two nozzle groups 51 other than the nozzle groups 51*a*, 51*b*.

Figure 15A:
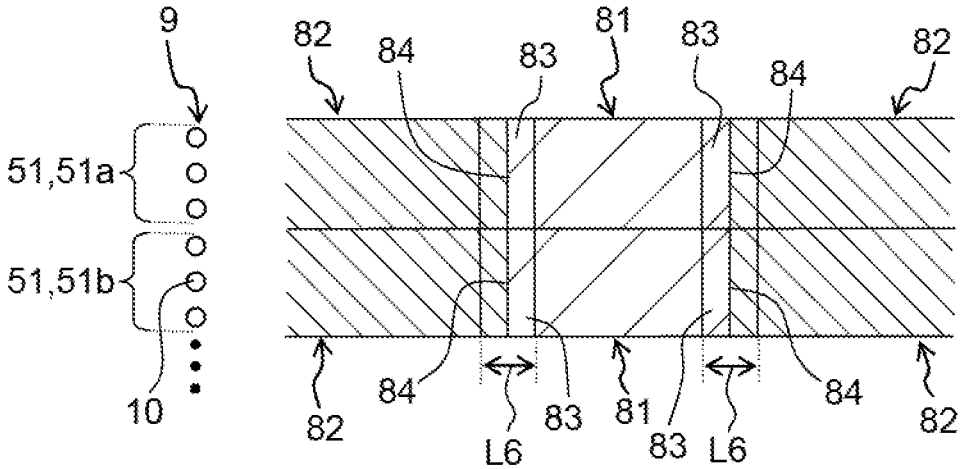
FIG. 15A is a view for explaining setting of a width of a boundary region, when boundary positions are the same for adjacent nozzle groups, in a ninth embodiment.

In the present embodiment, as depicted in FIG. 15A, when positions in the conveyance direction of the first region 81 and the second region 82 are the same for all of the nozzle groups 51 (when the first region 81 and the second region 82 are formed by all of the nozzles 10), a width L6 of the boundary region 83 is set.

Figure 15B:
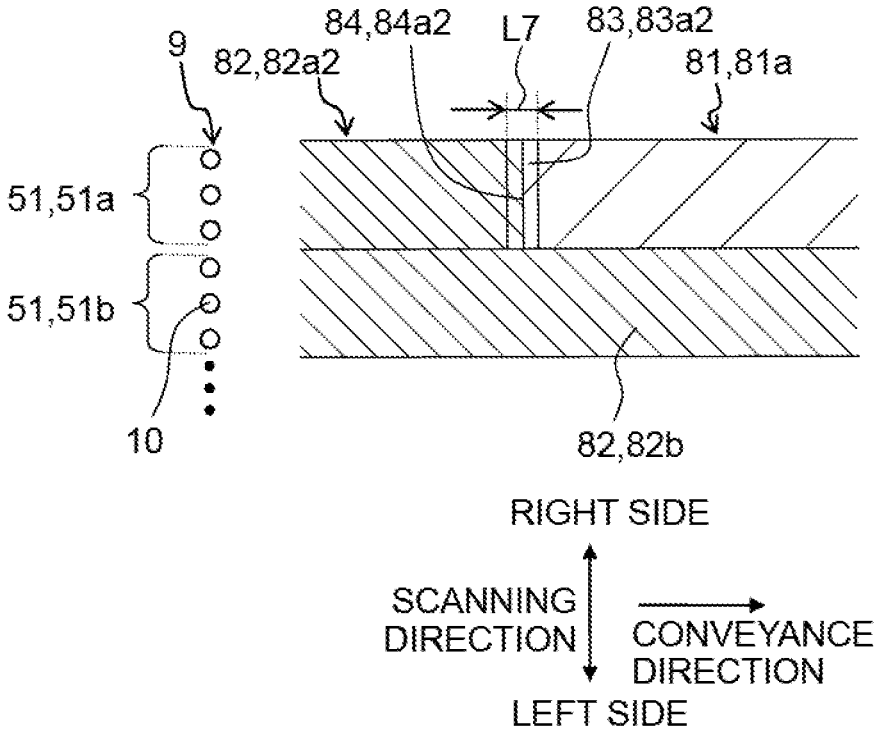
FIG. 15B is a view for explaining setting of the width of the boundary region, when the boundary positions are out of alignment between the adjacent nozzle groups, in the ninth embodiment.

In contrast, as depicted in FIG. 15B, for the nozzle group 51*a*, a first region 81*a* and a second region 82*a*2 on an upstream side of that first region 81*a* are set sharing a boundary 84*a*2. For the nozzle group 51*b*, a second region 82*b* is set. At this time, since the boundary 84*a*2 is positioned between both ends of the second region 82*b* in the conveyance direction, a width L7 of a boundary region 83*a*2 including the boundary 84*a*2 is set smaller than the above-mentioned width L6.

In this positional relationship, the boundary region 83*a*2 is adjacent to the second region 82*b* in the scanning direction. In the boundary region 83*a*2, there is a change in discharge speed (V1 to V2). On the other hand, in the second region 82*b*, a speed is the second discharge speed V2. At this time, some difference occurs in density between a portion on a second region 82*a*2 side of the boundary region 83*a*2 and the second region 82*b*. Accordingly, in the present embodiment, the width L7 of the boundary region 83*a*2 is set short. As a result, a portion where the above-described difference of density occurs can be made extremely small, thereby making density unevenness inconspicuous.

Next, a tenth embodiment of the present teaching will be described. In the present embodiment, in addition to the width of the boundary region 83 being set similarly to in the above-mentioned ninth embodiment, the width of the boundary region 83 is set as described below.

Figure 16A:
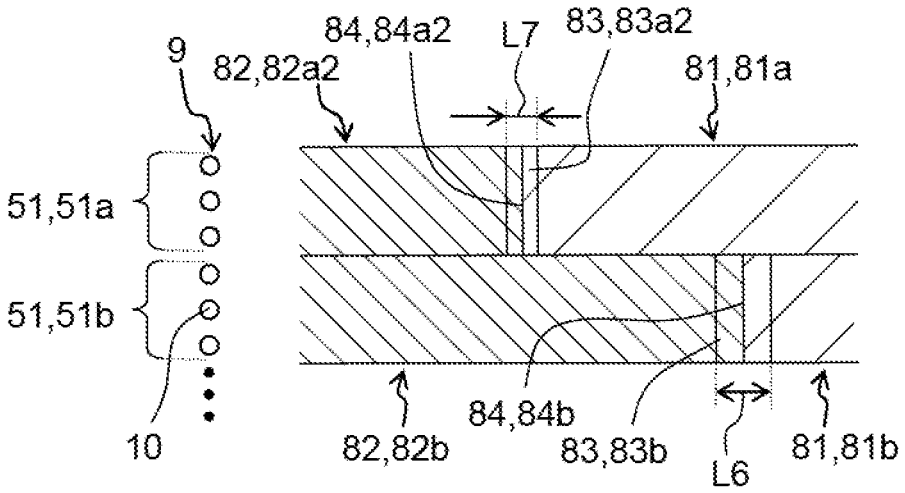
FIG. 16A is a view for explaining setting of a width of a boundary region in a tenth embodiment.

Describing in more detail, in the present embodiment, as depicted in FIG. 16A, the two nozzle groups 51*a*, 51*b* both have second regions 82 (82*a*, 82*b*) on an upstream side in the conveyance direction and first regions 81 (81*a*, 81*b*) on a downstream side in the conveyance direction, set. The two regions 81, 82 make contact sharing boundaries 84 (84*a*, 84*b*). At this time, when the boundary 84*b* (an end on the upstream side of the first region 81*b*) is positioned between both ends of the first region 81*a*, a width of the boundary region 83*b* including the boundary 84*b* is set to the above-described width L6.

The boundary region 83*b* is not adjacent in the scanning direction to the second region 82 corresponding to the nozzle group 51*a*. Accordingly, in the present embodiment, by lengthening the width of the boundary region 83*b* by setting it to L6, a change in discharge speed when performing recording to the boundary region 83*b* is made gentle. As a result, unevenness of density within the boundary region 83*b* can be made inconspicuous.

Next, an eleventh embodiment of the present teaching will be described. In the present embodiment, in addition to the width of the boundary region 83 being set similarly to in the above-mentioned ninth embodiment, the width of the boundary region 83 is set as described below.

Figure 16B:
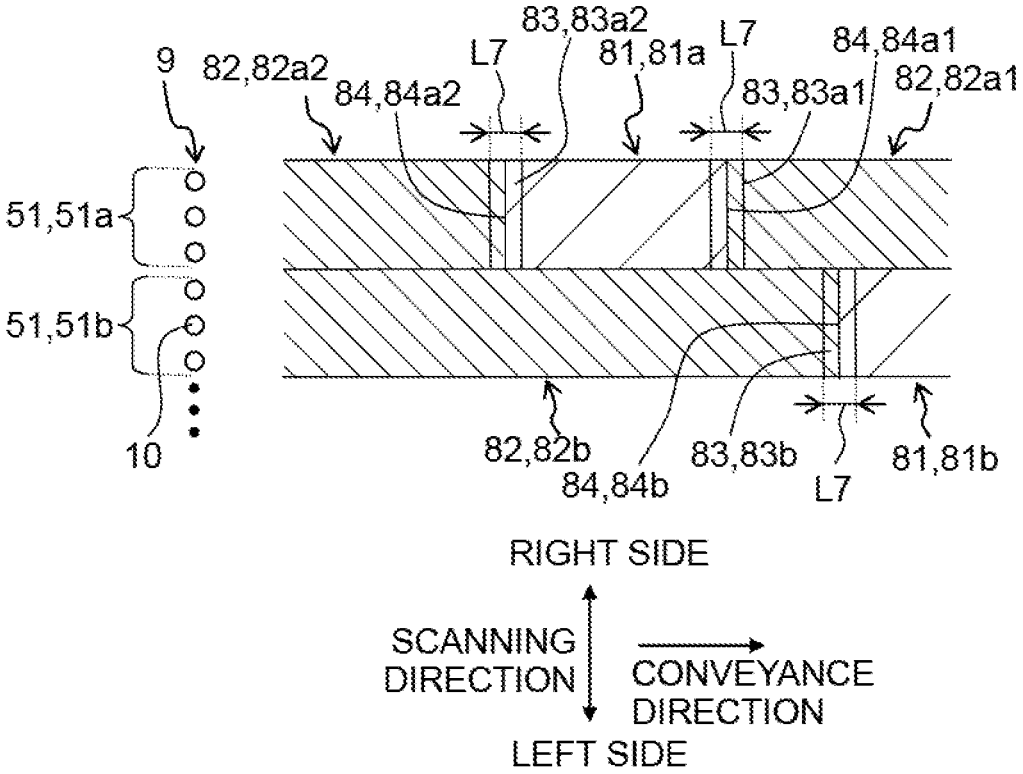
FIG. 16B is a view for explaining setting of a width of a boundary region in an eleventh embodiment.

Describing in more detail, in the present embodiment, the second region 82*a*2 on the upstream side in the conveyance direction, the first region 81*a* on the downstream side in the conveyance direction, and a second region 82*a*1 further on the downstream side in the conveyance direction, are set with respect to the nozzle group 51*a*. As depicted in FIG. 16B, when, in the conveyance direction, a boundary 84*a*1 of the first region 81*a* and the second region 82*a*1 is positioned between both ends of the second region 82*b* and the boundary 84*b* of the second region 82*b* and the first region 81*b* (an end on the upstream side of the first region 81*b*) is positioned between both ends of the second region 82*a*1, widths of the boundary region 83*b* including the boundary 84*b* and a boundary region 83*a*1 including the boundary 84*a*1 are set to the above-described L7.

As a result, similarly to as described in the ninth embodiment, a portion where a difference occurs in density, in regions adjacent in the scanning direction, of the second region 82$a$1 and the second region 82$b$, can be made extremely small, thereby making density unevenness inconspicuous.

Next, a twelfth embodiment of the present teaching will be described. In the present embodiment, in addition to the width of the boundary region 83 being set similarly to in the above-mentioned ninth embodiment, the width of the boundary region 83 is set as described below.

Figure 17A:
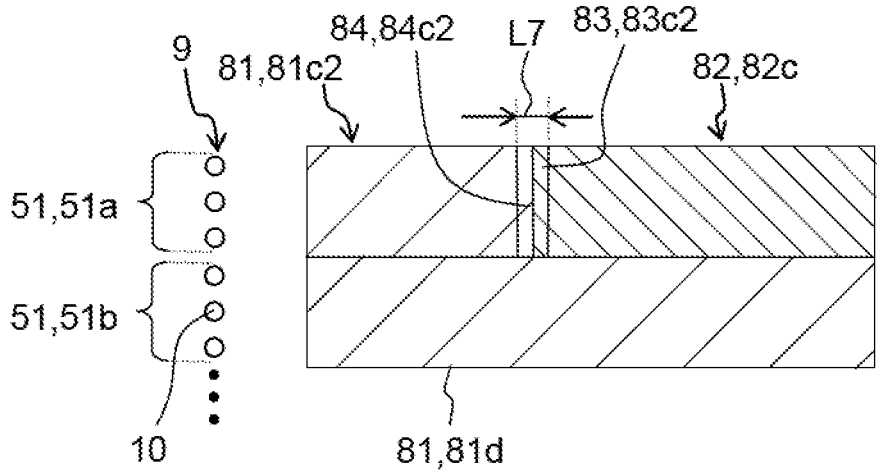
FIG. 17A is a view for explaining setting of a width of a boundary region in a twelfth embodiment.

Describing in more detail, in the present embodiment, as depicted in FIG. 17A, when a boundary 84$c$2 of a second region 82$c$ and a first region 81$c$2 adjacent on an upstream side to the second region 82$c$ regarding the nozzle group 51$a$ is positioned between both ends of a certain first region 81$d$ regarding the nozzle group 51$b$, a width of a boundary region 83$c$2 including a boundary 84$c$2 is set to the above-described width L7 which is shorter than the above-described width L6.

In this positional relationship, the boundary region 83$c$2 is adjacent to the first region 81$d$ in the scanning direction. In the boundary region 83$c$2, the discharge speed changes (V2⇒V1). On the other hand, in the first region 81$d$, a speed is the first discharge speed V1. At this time, some difference occurs in density between a first region 81$c$2 side portion of the boundary region 83$c$2 and the first region 81$d$. Accordingly, in the present embodiment, the width of the boundary region 83$c$2 is set to the width L7 which is shorter than the width L6. As a result, a portion where the above-described difference of density occurs can be made extremely small, thereby making density unevenness inconspicuous.

Next, a thirteenth embodiment of the present teaching will be described. In the present embodiment, in addition to the width of the boundary region 83 being set similarly to in the above-mentioned twelfth embodiment, the width of the boundary region 83 is set as described below.

Figure 17B:
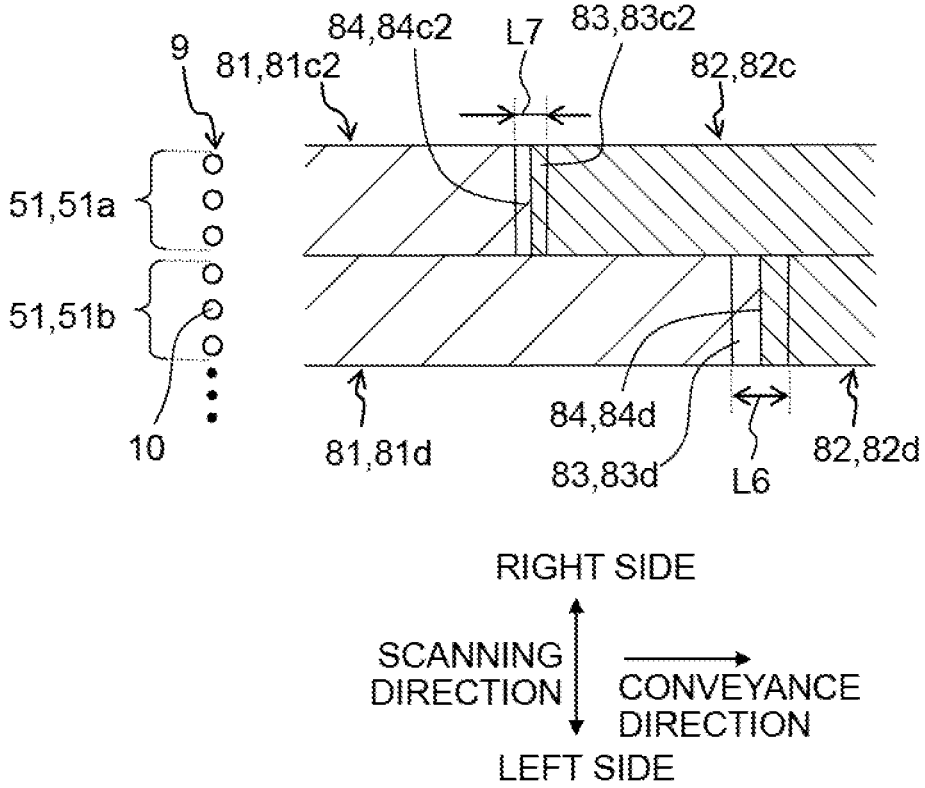
FIG. 17B is a view for explaining setting of a width of a boundary region in a thirteenth embodiment.

Describing in more detail, in the present embodiment, as depicted in FIG. 17B, the two nozzle groups 51$a$, 51$b$ both have first regions 81 (81$c$2, 81$d$) on an upstream side in the conveyance direction and second regions 82 (82$c$, 82$d$) on a downstream side in the conveyance direction, set. The two regions 81, 82 make contact sharing boundaries 84 (84$c$2, 84$d$). At this time, when the boundary 84$d$ (an end on the upstream side of the second region 82$d$) is positioned between both ends of the second region 82$c$, a width of the boundary region 83$d$ including the boundary 84$d$ is set to the above-described L6.

The boundary region 83$d$ is not adjacent in the scanning direction to the second region 82 for the nozzle group 51$a$. Accordingly, in the present embodiment, by lengthening the width of the boundary region 83$d$ by setting it to the above-described L6, a change in discharge speed when performing recording to the boundary region 83$d$ is made gentle. As a result, unevenness of density within the boundary region 83$d$ can be suppressed.

Next, a fourteenth embodiment of the present teaching will be described. In the present embodiment, in addition to the width of the boundary region 83 being set similarly to in the above-mentioned twelfth embodiment, the width of the boundary region 83 is set as described below.

Figure 18:
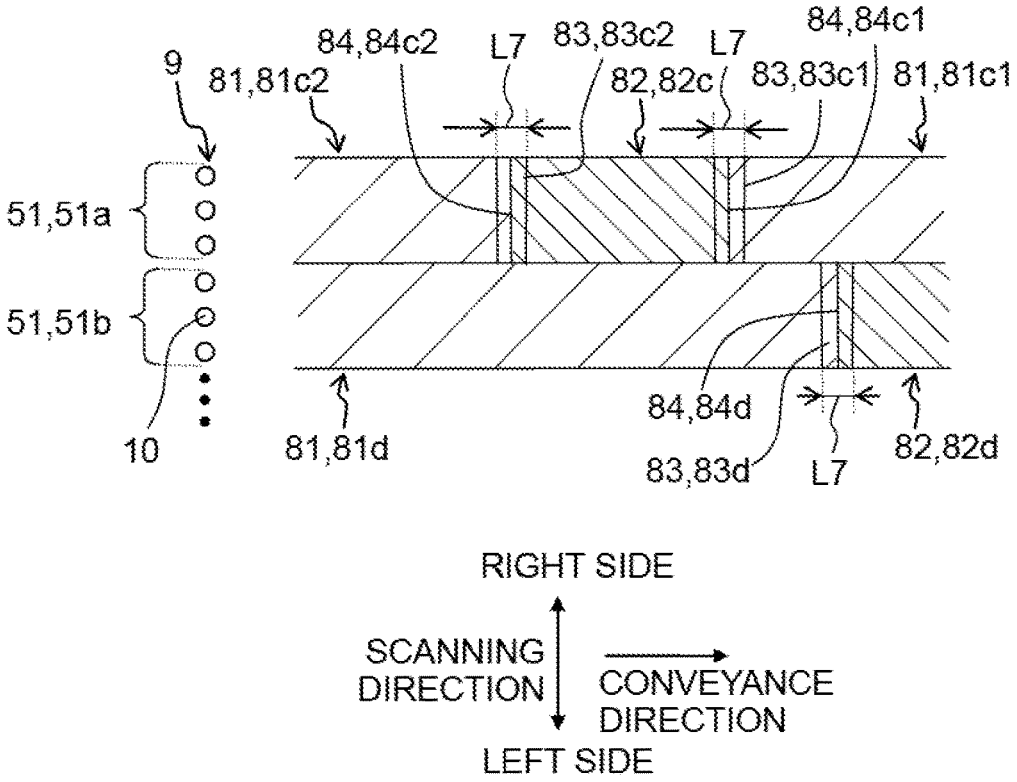
FIG. 18 is a view for explaining setting of a width of a boundary region in a fourteenth embodiment.

Describing in more detail, in the present embodiment, the first region 81$c$2 on the upstream side in the conveyance direction, the second region 82$c$ on the downstream side in the conveyance direction, and a first region 81$c$1 further on the downstream side in the conveyance direction, are set with respect to the nozzle group 51$a$. As depicted in FIG. 18, when, in the conveyance direction, a boundary 84$c$1 of the first region 81$c$1 and the second region 82$c$ is positioned between both ends of the first region 81$d$ and the boundary 84$d$ of the first region 81$d$ and the second region 82$d$ (an end on the upstream side of the second region 82$d$) is positioned between both ends of the first region 81$c$1, widths of the boundary region 83$d$ including the boundary 84$d$ and a boundary region 83$c$1 including the boundary 84$c$1 are set to the above-described L7.

As a result, similarly to as described in the ninth embodiment, a portion where a difference occurs in density, in regions aligned adjacently in the scanning direction, of the first region 81$c$1 and the first region 81$d$, can be made extremely small, thereby suppressing density unevenness in the entire image.

Next, modified examples where various changes have been made to the first through fourteenth embodiments will be described.

In the first through fourteenth embodiments, the discharge speed was changed gradually in the boundary region. However, the present teaching is not limited to this. For example, in the boundary region, ink droplets may be discharged from the nozzle 10 at a constant discharge speed which is slower than the first discharge speed V1 and faster than the second discharge speed V2, such as an average discharge speed of the first discharge speed and the second discharge speed.

Moreover, in the first through fourteenth embodiments, the boundary region was configured as a region straddling the first region and the second region. However, the present teaching is not limited to this. The boundary region may have the boundary of the first region and the second region as one end in the conveyance direction. In this case, the boundary region will be configured by one portion of the first region or one portion of the second region only.

Moreover, setting of the boundary region or discharge speed may be performed by appropriately combining two or more of the first through fourteenth embodiments.

Figure 19:
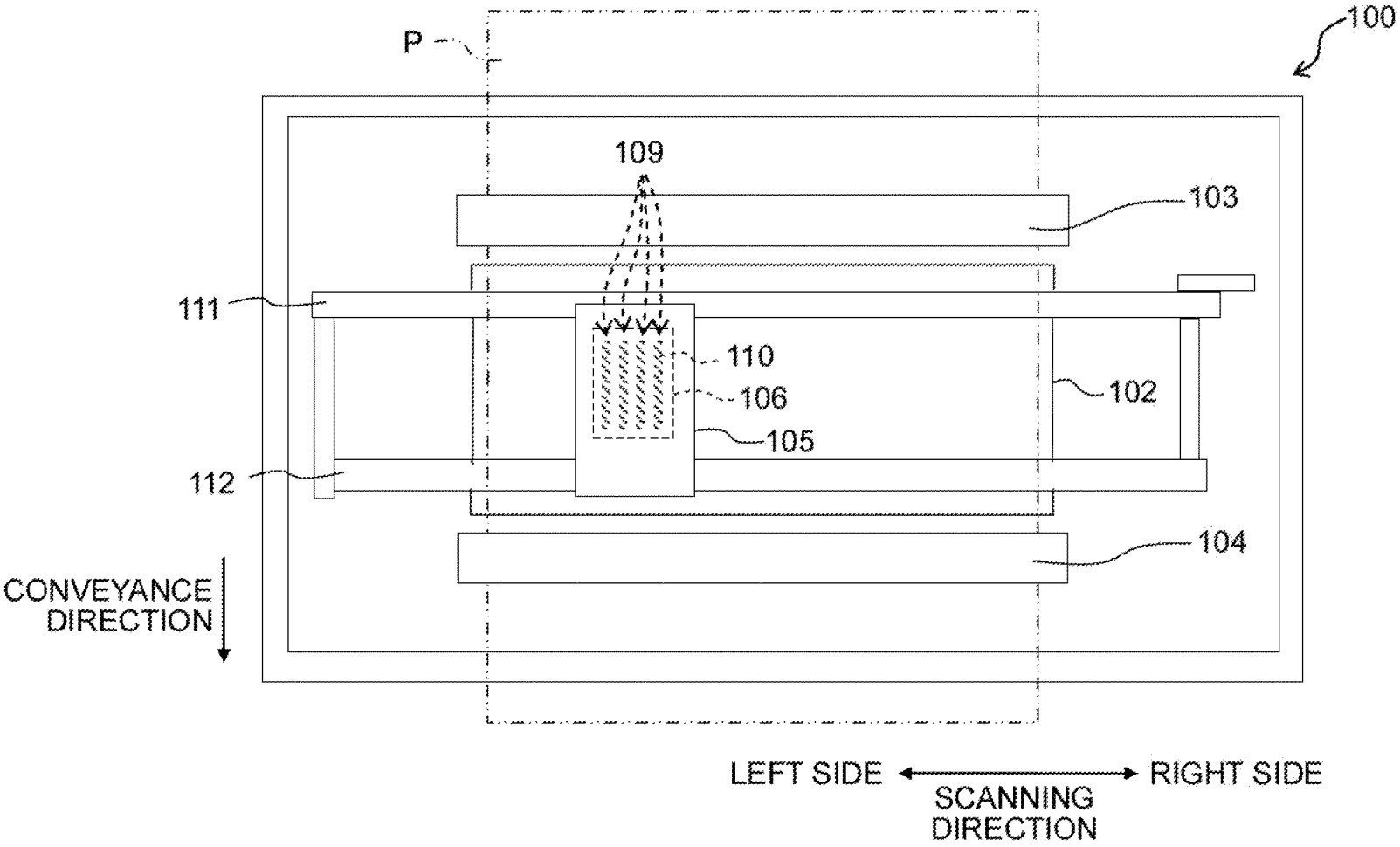
FIG. 19 is a schematic configurational view of a printer according to a modified example.

Moreover, embodiments where the present teaching was applied to a printer including a so-called line head were described above. However, the present teaching is not limited to this. In a modified example, as depicted in FIG. 19, a printer 100 may include the likes of a platen 102, conveyance rollers 103, 104, a carriage 105, and an ink-jet head 106. The platen 102 is similar to the platen 2 of the printer 1 (refer to FIG. 1). The conveyance rollers 103, 104 are similar to the conveyance rollers 3, 4 of the printer 1 (refer to FIG. 1).

The carriage 105 is supported by two guide rails 111, 112 that extend in the scanning direction. In addition, the carriage 105 is connected to an unillustrated motor via an unillustrated belt, and so on. Moreover, when this motor is driven, the carriage 105 moves in the scanning direction along the guide rails 111, 112.

The ink-jet head 106 is installed in the carriage 105 and moves in the scanning direction along with the carriage 105. That is, the ink-jet head 106 is a so-called serial head. The ink-jet head 106 discharges ink droplets from a plurality of nozzles 110 formed in its lower surface. Describing in more detail, the plurality of nozzles 110 form four nozzle rows 109 aligned in the scanning direction. Each of the nozzle rows 109 extends in the conveyance direction. Black, yellow, cyan, magenta ink droplets are discharged, in order from the right side, from the four nozzle rows 109.

Moreover, in the printer 100, the recording sheet P is conveyed a certain distance at a time in the conveyance direction by the conveyance rollers 103, 104. Every time the recording sheet P is conveyed, a unit recording operation that discharges ink droplets from the plurality of nozzles 110 while moving the carriage 105 in the scanning direction, is performed. As a result, recording is performed on the recording sheet P. In the unit recording operation, the recording sheet P moves relatively to the ink-jet head 106. In other words, the recording sheet P moves relatively in an opposite direction to a moving direction of the carriage 105, with respect to the ink-jet head 106. That is, in the present modified example, the opposite direction to the moving direction of the carriage 105 corresponds to a "moving direction" of the present teaching.

Figure 20:
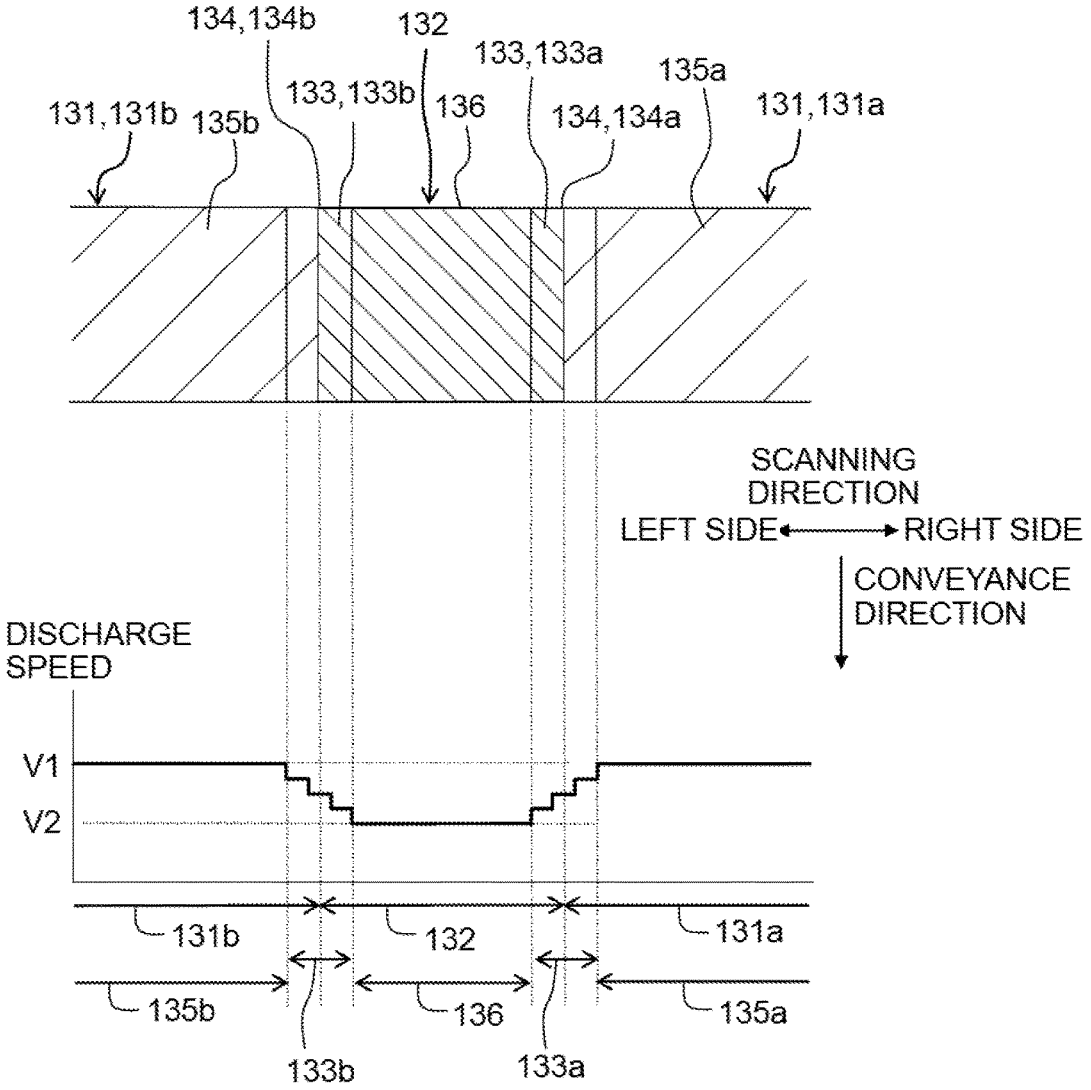
FIG. 20 is a view for explaining a first region, a second region, and a boundary region, and a discharge speed in each of the regions, in the modified example.

Moreover, in the present modified example, a region where recording is performed by each of the unit recording operations of the recording sheet P is discriminated as a first region 131 and a second region 132 aligned in the scanning direction as depicted in FIG. 20, based on image data of the image to be recorded. Moreover, a boundary region 133 including a boundary 134 of the first region 131 and the second region 132, is set. A way of setting of the boundary region 133 is similar to in the first embodiment, hence a further detailed description thereof will be omitted here.

Moreover, in the present modified example, regarding the scanning direction, a discharge speed with respect to a region 135*a* more to the right side than a boundary region 133*a* including a boundary 134*a*, of a first region 131*a*, is set to the first discharge speed V1. Moreover, regarding the scanning direction, a discharge speed with respect to a region 135*a* more to the left side than a boundary region 133*b* including a boundary 134*b*, of a first region 131*b*, is set to the first discharge speed V1. Moreover, regarding the scanning direction, a discharge speed with respect to a region 136 between the boundary region 133*a* and the boundary region 133*b*, of the second region 132, is set to the second discharge speed V2. Moreover, a discharge speed with respect to the boundary region 133*a* is set to a discharge speed which is between the first discharge speed V1 and the second discharge speed V2 and is of a kind that gradually quickens with increasing location to the right side in the scanning direction. Moreover, a discharge speed with respect to the boundary region 133*b* is set to a discharge speed which is between the first discharge speed V1 and the second discharge speed V2 and is of a kind that gradually slows with increasing location to the right side in the scanning direction.

Moreover, in the present modified example, in the unit recording operation, ink droplets are discharged from the nozzles 110 at the set discharge speeds onto each of the regions of the recording sheet P. Note that in the present modified example, when the carriage 105 moves from the left side to the right side in the unit recording operation, the image is recorded in order from a portion on the left side of the recording sheet P. On the other hand, when the carriage 105 moves from the right side to the left side in the unit recording operation, the image is recorded in order from a portion on the right side of the recording sheet P.

In the unit recording operation, when the carriage 105 is moved in the scanning direction, an air current in the scanning direction is generated between the ink-jet head 106 and the recording sheet P. Moreover, this air current and an air current generated by ink droplets being discharged from the nozzles 110 collide, whereby a composite air current of the two (the disturbance of air current) occurs. Accordingly, in the present modified example, in the unit recording operation, ink droplets are discharged from the nozzles 110 at the set discharge speeds onto each of the regions. As a result, similarly to as described in the first embodiment, it is possible to suppress a lowering of image quality in a boundary portion of the first region 131 and the second region 132 while suppressing the above-described disturbance of air current.

Moreover, although an example where the present teaching was applied to an ink-jet printer that performs recording by discharging ink droplets from nozzles, was described above, the present teaching is not limited to this. It is also possible for the present teaching to be applied to a recording apparatus that performs recording by discharging droplets of other than ink.

What is claimed is:

1. A recording apparatus configured to perform recording to a recording medium by discharging liquid droplets from a head while moving the recording medium and the head relatively, the recording apparatus comprising:

the head; and a controller, the controller being configured to:

based on received image data, discriminate a first region and a second region on the recording medium, the first region and the second region being adjacent in a moving direction of the recording medium with respect to the head, the first region being a region where an amount of the liquid droplets to be landed per unit area is less than a certain amount, and the second region being a region where an amount of the liquid droplets to be landed per unit area is greater than or equal to the certain amount;

set a boundary region that includes a boundary of the first region and the second region;

set a first discharge speed for a discharge speed of liquid droplets from the head to be landed to a first main region, the first main region included in the first region and positioned on an opposite side to the second region with respect to the boundary region;

set a second discharge speed slower than the first discharge speed for a discharge speed of liquid droplets from the head to be landed to a second main region, the second main region included in the second region and positioned on an opposite side to the first region with respect to the boundary region; and set a discharge speed between the first discharge speed and the second discharge speed for a discharge speed of liquid droplets from the head to be landed to the boundary region.

2. The recording apparatus according to claim 1, wherein the boundary region is divided into a first boundary region and a second boundary region by the boundary of the first region and the second region, the first boundary region is included in the first region, the second boundary region is included in the second region, in the case of performing recording from the first region to the second region adjacent on an upstream side in the moving direction, the controller is configured to set a third discharge speed, which is closer to the first discharge speed than to the second discharge speed, for the discharge speed of the liquid droplets from the head to be landed to the first boundary region.

3. The recording apparatus according to claim 2, wherein in the case of performing recording from the second region to the first region adjacent on an upstream side in the moving direction, the controller is configured to set a fourth discharge speed, which is closer to the second discharge speed than to the first discharge speed, for the discharge speed of the liquid droplets from the head to be landed to the second boundary region.

4. The recording apparatus according to claim 3,
wherein the controller is configured to:
based on the image data, acquire density information of each dot forming an image to be recorded;
based on the acquired density information of each dot, determine a discharge amount of liquid droplets to be discharged at the first discharge speed, for each dot;
correct the determined discharge amount so that the slower the discharge speed becomes as compared to the first discharge speed, the more the discharge amount of liquid droplets increases; and
based on the corrected discharge amount, discharge liquid droplets from the head.

5. The recording apparatus according to claim 3,
wherein the controller is configured to:
based on the image data, acquire density information of each dot forming an image to be recorded;
based on the acquired density information of each dot, determine a discharge amount of liquid droplets to be discharged at the first discharge speed, for each dot;
correct the determined discharge amount so that in the first region, the slower the discharge speed becomes as compared to the first discharge speed, the more the discharge amount of liquid droplets increases, and correct the determined discharge amount so that in the second region, the faster the discharge speed becomes as compared to the second discharge speed, the more the discharge amount of liquid droplets decreases; and
based on the corrected discharge amount, discharge liquid droplets from the head.

6. The recording apparatus according to claim 3,
wherein the controller is configured to:
execute thinning-out processing that thins out the image data, in a region, of the second region, belonging to the boundary region;
based on the image data after the thinning-out processing, discharge liquid droplets from the head; and
more greatly increase a thinning-out rate of the image data, the faster the discharge speed becomes as compared to the second discharge speed, in the thinning out processing.

7. The recording apparatus according to claim 3,
wherein the head has a plurality of nozzles arranged in an orthogonal direction orthogonal to the moving direction, and
the controller is configured to make the second discharge speed different in nozzles, which are included in the plurality of nozzles, to form the boundary region, and adjacent in the orthogonal direction.

8. The recording apparatus according to claim 3,
wherein the head has a plurality of nozzles arranged in an orthogonal direction orthogonal to the moving direction, and
the controller is configured to divide nozzles, which are included in the plurality of nozzles and to form the boundary region, into a plurality of nozzle groups aligned in the orthogonal direction, and make the second discharge speed different among adjacent ones of the nozzle groups.

9. The recording apparatus according to claim 1,
wherein the head has a plurality of nozzles arranged in an orthogonal direction orthogonal to the moving direction,
the controller is configured to:
divide nozzles, which are included in the plurality of nozzles and to form the boundary region into nozzle groups aligned in the orthogonal direction;
for each of the nozzle groups, discriminate the first region and the second region and set the boundary region;
under a condition that a certain nozzle group included in the nozzle groups forms the first region and the second region in this order in the moving direction, and another nozzle group included in the nozzle groups and adjacent to the certain nozzle group forms the first region and the second region in this order in the moving direction,
if an upstream end in the moving direction of the first region to be formed by the certain nozzle group is positioned between both ends in the moving direction of the second region to be formed by the another nozzle group, set a width of the boundary region to be formed by the certain nozzle group on an upstream side in the moving direction of the first region narrower, as compared to a width of the boundary region to be set in a case of forming the first region and the second region by all of the nozzles to form the boundary region.

10. The recording apparatus according to claim 9,
wherein under a condition that the certain nozzle group forms the second region on each of an upstream side and a downstream side of the first region in the moving direction to sandwich the first region therebetween, and the another nozzle group forms the first region and the second region in this order in the moving direction,
if the upstream end in the moving direction of the first region to be formed by the certain nozzle group is positioned between the both ends in the moving direction of the second region to be formed by the another nozzle group, and if an upstream end in the moving direction of the first region to be formed by the another nozzle group is positioned between both ends in the moving direction of the second region on the downstream side to be formed by the certain nozzle group:
set a width of the boundary region to be formed by the another nozzle group equivalent to a width of the boundary region to be formed by the certain nozzle group between the first region and the second region on an upstream side; and
set the width of the boundary region to be formed by the another nozzle group narrower, as compared to the width of the boundary region to be set in the case of forming the first region and the second region by all of the nozzles to form the boundary region.

11. The recording apparatus according to claim 9,
wherein under a condition that the certain nozzle group forms the first region and the second region in this order in the moving direction, and the another nozzle group forms the first region and the second region in this order in the moving direction,
if an upstream end in the moving direction of the first region to be formed by the another nozzle group is positioned between both ends in the moving direction of the first region to be formed by the certain nozzle group, set a width of the boundary region, on an upstream side in the moving direction of the first region, to be formed by the another nozzle group equivalent to the width of the boundary region to be set in the case of forming the first region and the second region by all of the nozzles to form the boundary region.

12. The recording apparatus according to claim 9,
wherein under a condition that the certain nozzle group forms the second region and the first region in this order in the moving direction, and the another nozzle group forms the second region and the first region in this order in the moving direction, if an upstream end in the moving direction of the second region to be formed by the certain nozzle group is positioned between both ends in the moving direction of the first region to be formed by the another nozzle group, set a width of the boundary region to be formed by the certain nozzle group on an upstream side in the moving direction of the first region narrower, as compared to the width of the boundary region to be set in the case of forming the first region and the second region by all of the nozzles to form the boundary region.

13. The recording apparatus according to claim 12, wherein under a condition that the certain nozzle group forms the first region on each of an upstream side and a downstream side of the second region in the moving direction to sandwich the second region therebetween, and the another nozzle group forms the second region and the first region in this order in the moving direction, if the upstream end in the moving direction of the second region to be formed by the certain nozzle group is positioned between the both ends in the moving direction of the first region to be formed by the another nozzle group, and if an upstream end in the moving direction of the second region to be formed by the another nozzle group is positioned between both ends in the moving direction of the first region on the downstream side to be formed by the certain nozzle group;

set a width of the boundary region to be formed by the another nozzle group equivalent to a width of the boundary region to be formed by the certain nozzle group between the second region and the first region on an upstream side; and, set the width of the boundary region to be formed by the another nozzle group narrower, as compared to the width of the boundary region to be set in the case of forming the first region and the second region by all of the nozzles to form the boundary region.

14. The recording apparatus according to claim 12, wherein under a condition that the certain nozzle group forms the second region and the first region in this order in the moving direction, and the another nozzle group forms the second region and the first region in this order in the moving direction, if an upstream end in the moving direction of the second region to be formed by the another nozzle group is positioned between both ends in the moving direction of the second region to be formed by the certain nozzle group, set a width of the boundary region to be formed by the another nozzle group equivalent to the width of the boundary region to be set in the case of forming the first region and the second region by all of the nozzles to form the boundary region.

15. The recording apparatus according to claim 1, wherein the head has:

a first nozzle row that extends in an orthogonal direction orthogonal to the moving direction; and a second nozzle row that extends in the orthogonal direction and is adjacent to the first nozzle row from an upstream side in the moving direction, and in the case of performing recording by the first nozzle row and the second nozzle row, the controller is configured to set the first discharge speed in the first nozzle row to a speed slower than the first discharge speed in the second nozzle row.

16. The recording apparatus according to claim 1, wherein the head has:

a first nozzle row that extends in an orthogonal direction orthogonal to the moving direction; and a second nozzle row that extends in the orthogonal direction and is adjacent to the first nozzle row from an upstream side in the moving direction, and in the case of performing recording by the first nozzle row and the second nozzle row, the controller is configured to set a length in the moving direction, of the boundary region in the first nozzle row, shorter than a length in the moving direction, of the boundary region in the second nozzle row.

17. The recording apparatus according to claim 1, wherein when recording on the first region and two of the second regions sandwiching this first region in the moving direction, the controller is configured to set the first discharge speed lower in the case that a length in the moving direction of the first region is less than a certain value as compared to in the case that the length in the moving direction of the first region is greater than or equal to the certain value.

18. The recording apparatus according to claim 1, further comprising a conveyor configured to convey the recording medium in the moving direction relative to the head, and the head is a page-width head.

19. The recording apparatus according to claim 1, further comprising:

a conveyor configured to convey the recording medium in a conveyance direction orthogonal to the moving direction; and a carriage on which the head is mounted, the carriage being configured to move the head in the moving direction relative to the recording medium conveyed by the conveyor.

20. A method for controlling a recording apparatus comprising a head and configured to perform a recording to a recording medium by discharging liquid droplets from the head while moving the recording medium and the head relatively, the method comprising:

based on received image data, discriminating a first region and a second region on the recording medium, the first region and the second region being adjacent in a moving direction of the recording medium with respect to the head, the first region being a region where an amount of the liquid droplets to be landed per unit area is less than a certain amount, and the second region being a region where an amount of the liquid droplets to be landed per unit area is greater than or equal to the certain amount;

setting a boundary region that includes a boundary of the first region and the second region;

setting a first discharge speed for a discharge speed of liquid droplets from the head to be landed to a first main region, the first main region included in the first region and positioned on an opposite side to the second region with respect to the boundary region;

setting a second discharge speed slower than the first discharge speed for a discharge speed of liquid droplets from the head to be landed to a second main region, the second main region included in the second region and positioned on an opposite side to the first region with respect to the boundary region; and setting a discharge speed between the first discharge speed and the second discharge speed for a discharge speed of liquid droplets from the head to be landed to the boundary region.

* * * * *